US009002217B2

(12) United States Patent
Seto

(10) Patent No.: US 9,002,217 B2
(45) Date of Patent: Apr. 7, 2015

(54) IMAGE FORMING APPARATUS WITH CARTRIDGE MOVING MEMBER HAVING DETECTION UNIT FOR ADJACENT CARTRIDGE

(71) Applicant: Canon Kabushiki Kaisha, Tokyo (JP)

(72) Inventor: Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 14/043,054

(22) Filed: Oct. 1, 2013

(65) Prior Publication Data

US 2014/0093257 A1 Apr. 3, 2014

(30) Foreign Application Priority Data

Oct. 1, 2012 (JP) ..... 2012-219617

(51) Int. Cl.

| | |
|---|---|
| ***G03G 15/00*** | (2006.01) |
| ***G03G 15/08*** | (2006.01) |
| ***G03G 15/10*** | (2006.01) |
| ***G03G 21/18*** | (2006.01) |

(52) U.S. Cl.
CPC ..... *G03G 21/1892* (2013.01)

(58) Field of Classification Search
USPC ..... 399/13, 25, 27, 61, 64
See application file for complete search history.

(56) References Cited

U.S. PATENT DOCUMENTS

| | | | | |
|---|---|---|---|---|
| 8,805,214 | B2 * | 8/2014 | Fujita et al. | 399/27 |
| 2007/0196114 | A1 * | 8/2007 | Okabe | 399/13 |
| 2008/0310882 | A1 * | 12/2008 | Kato et al. | 399/114 |
| 2009/0028601 | A1 * | 1/2009 | Mizuno et al. | 399/111 |
| 2009/0290905 | A1 * | 11/2009 | Mizuno et al. | 399/111 |
| 2011/0058825 | A1 * | 3/2011 | Tsukijima | 399/27 |
| 2011/0123205 | A1 * | 5/2011 | Satomura | 399/27 |
| 2011/0299873 | A1 * | 12/2011 | Ushiozu et al. | 399/90 |
| 2012/0275823 | A1 * | 11/2012 | Mizuno et al. | 399/111 |
| 2012/0321343 | A1 * | 12/2012 | Mizuno et al. | 399/111 |

FOREIGN PATENT DOCUMENTS

| | | | | |
|---|---|---|---|---|
| JP | 2004301896 | A * | 10/2004 | G03G 15/08 |
| JP | 2006337418 | A * | 12/2006 | |
| JP | 2008145793 | A * | 6/2008 | |
| JP | 2009265464 | A * | 11/2009 | |
| JP | 2010-091667 | A | 4/2010 | |
| JP | 2010107775 | A * | 5/2010 | |

* cited by examiner

*Primary Examiner* — David Bolduc
(74) *Attorney, Agent, or Firm* — Canon U.S.A., Inc. IP Division

(57) ABSTRACT

The present invention provides an image forming apparatus including a moving member configured to support a first process cartridge and move the first process cartridge to a position for forming an image, and a detection unit configured to detect a state of a second process cartridge, in which the moving member holds the detection unit.

10 Claims, 15 Drawing Sheets

IMAGE FORMING APPARATUS WITH CARTRIDGE MOVING MEMBER HAVING DETECTION UNIT FOR ADJACENT CARTRIDGE

BACKGROUND

1. Field

Aspects of the present invention generally relate to a tandem type image forming apparatus that forms an image using a plurality of process cartridges each including a photosensitive member, a developing unit, and the like, and relates to an image forming apparatus such as an electrophotographic copying machine, a laser printer, and a facsimile apparatus.

2. Description of the Related Art

Conventionally, a process cartridge, which is formed by integrating an image bearing member such as a photosensitive member and a developing unit and is configured to be detachably mountable on an image forming apparatus main body, has been widely employed in electrophotographic image forming apparatuses such as color electrophotographic copying machines and color printers.

Japanese Patent Application Laid-Open No. 2010-91667 discusses a configuration in which a process cartridge is employed as an image forming unit, in an image forming apparatus according to the tandem type system (a system in which image forming units including photosensitive members, developing units, and the like for respective colors are arranged in series in a direction in which a transfer member travels, and a color image is formed by the image forming units).

Further, a configuration illustrated in FIGS. 14A and 14B is known as a conventional tandem type image forming apparatus. In FIGS. 14A and 14B, members having similar functions to the present exemplary embodiments that will be described below are identified by the same reference numerals. FIG. 14A is a main cross-sectional view illustrating an image forming apparatus with process cartridges 7 slid from the front of an apparatus main body 100A and mounted therein. FIG. 14B is a cross-sectional view illustrating the image forming apparatus with the process cartridges 7 moved to positions allowing image formation by raising guide rails 66 (moving members) from the state illustrated in FIG. 14A. In this manner, the process cartridges 7 are inserted into the guide rails 66 of the apparatus main body 100A with a certain space maintained between photosensitive members 1 and a belt 5 (FIG. 14A). After that, the photosensitive members 1 of the process cartridges 7 are brought into contact with the belt 5 serving as a transfer unit by raising the guide rails 66. Owing to this arrangement, the photosensitive members 1 are prevented from being rubbed against the belt 5 when the process cartridges 7 are being inserted in the apparatus main body 100A.

In the configuration illustrated in FIGS. 14A and 14B, detection units 8 for detecting remaining toner amounts in developing units 4 are held by holders 65. The holders 65 are fixed on a partition plate 80 in the apparatus main body 100A. The guide rails 66 are configured separately from the holders 65.

In the above-described conventional tandem type image forming apparatus, sufficient spaces are provided between the holders 65 and the moving members 66 so as to prevent the holders 65 holding the detection units 8 and the moving members 66 from contacting each other and interfering with each other when the process cartridges 7 are being moved to the positions allowing image formation by the moving members 66. This results in an increase in the distance between the adjacent process cartridges 7, leading to an increase in the size of the image forming apparatus main body 100A in the direction in which the process cartridges 7 are arranged.

SUMMARY

An aspect of the present invention is generally directed to a tandem type image forming apparatus that forms an image using a plurality of process cartridges in an image forming apparatus main body of a reduced size in a direction in which the process cartridges are arranged.

According to an aspect of the present invention, an image forming apparatus includes a moving member configured to support a first process cartridge and move the first process cartridge to a position for forming an image, and a detection unit configured to detect a state of a second process cartridge, in which the moving member holds the detection unit.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles of the disclosure.

DESCRIPTION OF THE EMBODIMENTS

Various exemplary embodiments, features, and aspects of the disclosure will be described in detail below with reference to the drawings.

Figure 1:
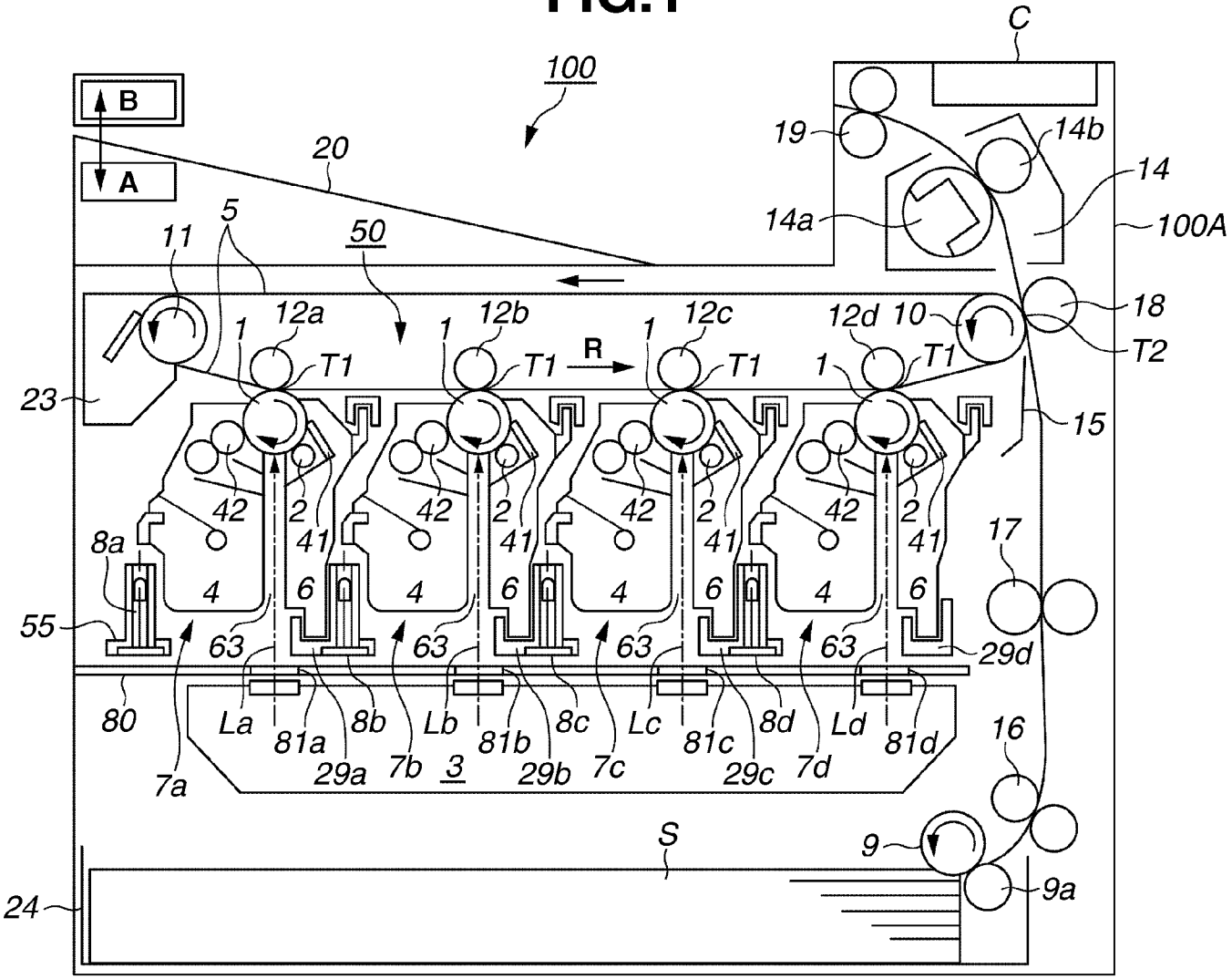
FIG. 1 is a cross-sectional view illustrating an image forming apparatus according to a first exemplary embodiment.

FIG. 1 is a schematic vertical cross-sectional view illustrating an image forming apparatus 100 according to a first exemplary embodiment, and illustrates the image forming apparatus 100 performing an image forming operation.

Figure 2:
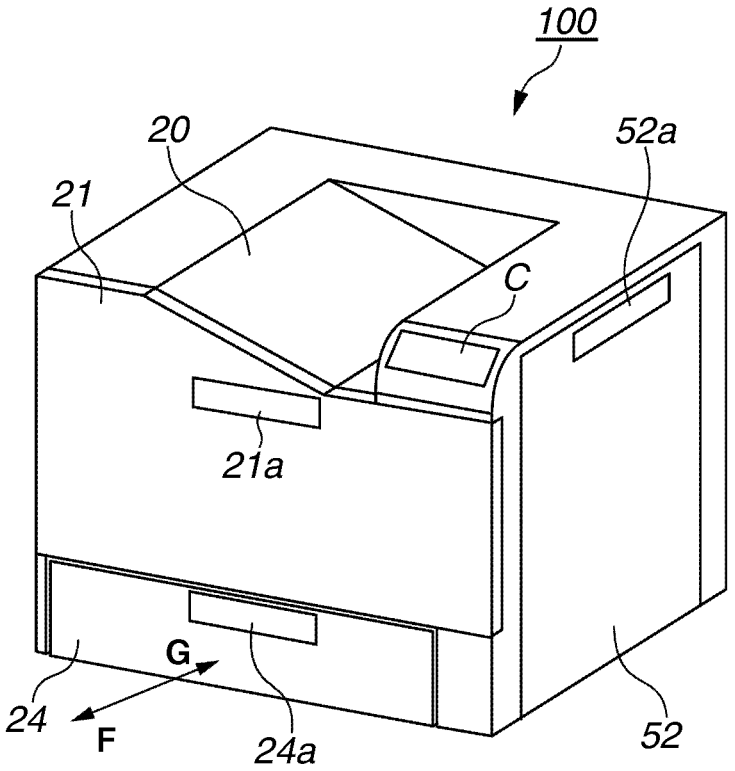
FIG. 2 is a perspective view illustrating the image forming apparatus according to the first exemplary embodiment with a door closed.
Figure 3:
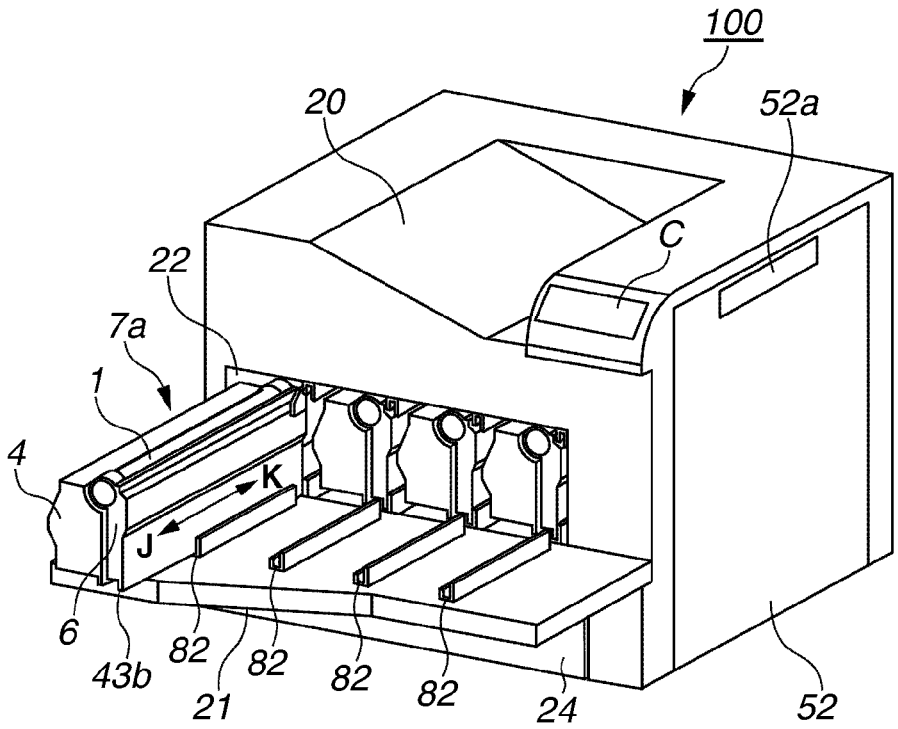
FIG. 3 is a perspective view illustrating an operation of inserting/pulling out a process cartridge into/from the image forming apparatus according to the first exemplary embodiment with the door opened.

FIG. 2 is an external perspective view illustrating the image forming apparatus 100 with a door (an opening/closing member) 21, which is used to open and close an apparatus main body 100A, closed. FIG. 3 illustrates the image forming apparatus 100 with the door 21 opened and illustrates that a process cartridge 7*a* is being inserted into or pulled out from the apparatus main body 100A.

Regarding the image forming apparatus 100 according to the present exemplary embodiment, the term "front surface side" or "front side" refers to a portion of the image forming apparatus 100 where the door 21 is disposed, and the portion is on an upstream side of the process cartridge in a mounting direction (hereinafter referred to as the cartridge) 7. The term "back surface side" or "back side" refers to a side opposite from the front surface side, and a downstream side in the mounting direction of the cartridge 7. The term "front-back direction" refers to a direction from the back surface side toward the front surface side (a forward direction) and the opposite direction therefrom (a backward direction). The term "left/right" refers to the left side or the right side when the image forming apparatus 100 is viewed from the front surface side. The term "left-right direction" refers to a direction from the right side to the left side (a leftward direction), and the opposite direction therefrom (a rightward direction). The image forming apparatus main body (hereinafter referred to as the apparatus main body) 100A means the configuration of the image forming apparatus 100 with the cartridges 7 removed therefrom. Further, regarding the cartridge 7 or component members thereof, or component members of the apparatus main body side, the term "longitudinal direction" refers to an axial direction of an electrophotographic photosensitive drum (an image bearing member: hereinafter referred to as a drum) 1 included in the cartridge 7 or a direction in parallel with the axial direction thereof. Further, the term "lateral direction" refers to a direction perpendicular to the axial direction of the drum 1. Regarding the cartridge 7, the term "driven side" refers to a side where driving is transmitted from the apparatus main body 100A in the longitudinal direction of the cartridge 7, and the term "non-driven side" refers to the opposite side thereof.

The image forming apparatus 100 according to the present exemplary embodiment is a laser beam printer (a color image forming apparatus) that forms a full-color image with four colors with use of the electrophotographic process. In other words, the image forming apparatus 100 forms an image on a sheet-shaped recording medium S (for example, paper, an overhead projector (OHP) sheet, and a label) based on an electric image signal input from an external host apparatus B such as a personal computer and an image reader, into a control circuit unit (a controller: a central processing unit (CPU)) A. The control circuit unit A carries out communication of various kinds of electric information between the external host apparatus B and an operation unit C, and comprehensively controls an image forming operation of the image forming apparatus 100 according to a predetermined control program and a reference table.

This image forming apparatus 100 is configured such that a plurality of cartridges, i.e., first to fourth cartridges 7 (7*a* to 7*d*) in the image forming apparatus 100 according to the present exemplary embodiment is detachably mounted on the apparatus main body 100A for use in the image forming. The cartridges 7 can be respectively independently mounted to or detached from cartridge mounting portions 22 within the apparatus main body 100A by opening the door 21 of the apparatus main body 100A to expose the front surface side of the apparatus main body 100A as illustrated in FIG. 3. The respective cartridges 7 are mounted such that the cartridges 7 are inserted into the cartridge mounting portions 22 in the longitudinal directions of the cartridges 7 extending along the front-back direction, and are positioned where image formation can be performed.

The respective cartridges 7 include electrophotographic process mechanisms similar to one another. The respective cartridges 7 according to the present exemplary embodiment include a photosensitive member unit (an image bearing member unit) 6 having a drum 1 and a charging roller (a charging unit) 2 as a process unit that works on the drum 1, and a developing unit (a developing unit) 4. In the image forming apparatus 100 according to the present exemplary embodiment, the cartridge 7*a* contains a developer (hereinafter referred to as a toner) of yellow (Y) color in a toner containing chamber of the developing unit 4. The cartridge 7*b* contains a toner of magenta (M) color in the toner containing chamber of the developing unit 4. The cartridge 7*c* contains a toner of cyan (C) color in the toner containing chamber of the developing unit 4. The cartridge 7*d* contains a toner of black (K) color in the toner containing chamber of the developing unit 4.

Rotational driving forces are transmitted from the apparatus main body 100A to the respective cartridges 7*a* to 7*b* mounted at the positions where image formation can be carried out, in order to drive and rotate the drums 1 at predetermined speeds in the clockwise directions indicated by arrows. Further, predetermined biases (for example, charging biases and developing biases) are supplied from the apparatus main body 100A to the respective cartridges 7*a* to 7*b*.

In the apparatus main body 100A, a laser scanner unit 3 is disposed below the cartridge mounting portions 22 as an image information exposure unit for the drums 1 of the respective cartridges 7.

Further, in the apparatus main body 100A, an intermediate transfer belt unit 50 is disposed above the cartridge mounting portions 22. This unit 50 includes a driving roller 10 arranged at the right side, a tension roller 11 arranged at the left side, and an intermediate transfer belt (hereinafter referred to as a belt) 5 wound in a suspended manner and stretched tightly between the rollers 10 and 11. The drums 1 of the respective cartridges 7 mounted on the positions where image formation can be performed are, at the top surface portions thereof, in contact with the bottom surface of the belt 5. These contact portions are primary transfer portions T1. Further, four transfer rollers, i.e., first to fourth primary transfer rollers 12 (12*a* to 12*d*) opposing the drums 1 of the respective cartridges 7 across the belt 5 are arranged in parallel with one another inside the lower-side belt portion. The rotational axis directions of the primary rollers 12 extend along the front-back direction. The belt 5 is circularly moved by the driving roller 10 at a speed corresponding to the rotational speeds of the drums 1 in the counterclockwise direction indicated by an arrow R. The lower-side portion of the belt 5 is in contact with the top surface portions of the drums 1 of the respective cartridges 7. Predetermined primary transfer biases are applied to the respective primary transfer rollers 12*a* to 12*d* at predetermined control timings. A secondary transfer roller 18 is disposed on an outer side of a belt bending portion of the driving roller 10. The contact portion between the belt 5 and the secondary transfer roller 18 is a secondary transfer portion T2. A predetermined secondary transfer bias is applied to the secondary transfer roller at predetermined control timing. A transfer belt cleaning device 23 is disposed on an outer side of a belt bending portion of the tension roller 11.

A recording medium feeding device 13 is disposed at the lower portion of the apparatus main body 100A. The recording medium feeding device 13 includes a feeding cassette 24 containing recording media (transfer materials) S, a roller pair of a feeding roller 9 and a retard roller 9*a*, and a conveyance roller pair 16. Further, a recording medium conveyance unit is disposed from the recording medium feeding device 13 to the upper side of the apparatus main body 100A at the right side within the apparatus main body 100A. The recording medium conveyance unit includes a registration roller pair 17, a conveyance path 15, the secondary transfer portion T2, a fixing unit (a fixing unit) 14, and a discharge roller pair 19. The top surface of the apparatus main body 100A forms a discharge tray 20.

The feeding cassette 24 is pulled out from and inserted into the apparatus main body 100A in a front-access manner. A grip portion 24*a* is provided in the feeding cassette 24. In other words, the feeding cassette 24 is configured to be pulled out to the front side of the apparatus main body 100A as indicated by an arrow F illustrated in FIG. 2. A user detaches the feeding cassette 24 from the apparatus main body 100A and then sets the recording media S in the feeding cassette 24. Replenishment of the recording media S is completed by inserting this feeding cassette 24 into the apparatus main body 100A as indicated by an arrow G illustrated in FIG. 2.

A rotatably attached right-side surface door 52 is disposed at the right-side surface side of the apparatus main body 100A. The right-side surface door 52 can be rotated to expose the conveyance path 15 by pulling a grip portion 52*a* attached to the right-side surface door 52. In this manner, it is possible to secure a work space for removing the jammed recording medium S when the recording medium S is jammed.

The image forming apparatus 100 operates to form a full-color image in the following manner. The control circuit unit A starts an image forming operation of the image forming apparatus 100 based on a print start signal. In other words, the drums 1 of the respective cartridges 7 (7*a* to 7*d*) are rotationally driven at predetermined speeds in the clockwise directions indicated by the arrows in synchronization with an image forming timing. The belt 5 is also rotationally driven at a speed corresponding to the speeds of the drums 1 in the counterclockwise direction (the forward directions of the rotations of the drums 1) indicated by the arrow R. The laser scanner unit 3 is also driven. In synchronization with this driving, the surfaces of the drums 1 of the respective cartridges 7 are evenly charged by the charging rollers 2 to which the predetermined charging biases are applied, so as to have predetermine polarities and predetermined potentials. The laser scanner unit 3 scans and exposes the surfaces of the respective drums 1 to modulated laser beams L (La to Ld) according to image information signals of the respective colors Y, M, C, and K. The laser beams L are respectively upwardly emitted from windows 81 (81*a* to 81*d*) formed at the top surface plate 80 of the laser scanner unit 3. The laser beams L emitted from the laser scanner unit 3 are introduced into the corresponding cartridges 7 through laser beam entry openings 63 formed at the lower sides, and are applied to the bottom surfaces of the drums 1. As a result, electrostatic latent images are formed on the surfaces of the respective drums 1 according to the image information signals of the corresponding colors. The formed electrostatic latent images are developed by developing rollers 42 of the developing units 4 as toner images.

A Y-color toner image corresponding to a yellow component of a full-color image is formed on the drum 1 of the cartridge 7*a* by the above-described electrophotographic image forming process operation. This toner image is primarily transferred onto the belt 5 at the primary transfer portion T1 of the cartridge 7*a*. An M-color toner image corresponding to a magenta component of the full-color image is formed on the drum 1 of the cartridge 7*b*. This toner image is primarily transferred onto the belt 5 and superimposed on the Y-color toner image that has been already transferred on the belt 5, at the primary transfer portion T1 of the cartridge 7*b*. A C-color toner image corresponding to a cyan component of the full-color image is formed on the drum 1 of the cartridge 7*c*. This toner image is primarily transferred onto the belt 5 and superimposed on the Y-color toner image and M-color toner image that have been already transferred on the belt 5, at the primary transfer portion T1 of the cartridge 7*c*. A K-color toner image corresponding to a black component of the full-color image is formed on the drum 1 of the cartridge 7*d*. This toner image is primarily transferred onto the belt 5 and superimposed on the Y-color toner image, the M-color toner image, and the C-color toner image that have been already transferred on the belt 5, at the primary transfer portion T1 of the cartridge 7*d*. The primary transfer biases having reverse polarities of the toner charging polarities, and predetermined potentials are applied to the respective first to fourth primary transfer rollers 12 (12*a* to 12*d*) at predetermined control timings.

In this manner, unfixed toner images are combined and formed on the moving belt 5 with four full colors of Y color, M color, C color, and K color. These unfixed toner images are conveyed by the continuing rotation of the belt 5 to reach the secondary transfer portion T2.

At the respective cartridges 7, primary transfer residual toners are removed from the surfaces of the drums 1 after the primary transfers of the toner images onto the belt 5 by cleaning members 41 of photosensitive member units 6. The surfaces of the drums 1 are cleaned in this manner and are subjected for a next image forming process.

On the other hand, a single recording medium S in the feeding cassette 24 is fed by the feeding roller 9 and the retard roller 9*a* at a predetermined control timing, and is conveyed to the registration roller pair 17 by the conveyance roller pair 16. The recording medium S is conveyed to the secondary transfer portion T2 via the conveyance path 15 at predetermined control timing by the registration roller pair 17. The secondary transfer bias having a reverse polarity of the toner charging polarity and a predetermined potential is applied to the secondary transfer roller 18 at predetermined control timing. As a result, while the recording medium S is conveyed through the secondary transfer portion T2, being sandwiched by the secondary transfer portion T2, the four-color superimposed toner images on the belt 5 are secondarily transferred onto the surface of the recording medium S sequentially and collectively. After exiting the secondary transfer portion T2, the recording medium S is separated from the belt 5, and is conveyed to the fixing unit 14. Then, heat and a pressure are added to the recording medium S while the recording medium S is sandwiched by and conveyed through a fixing nip portion and the toner images are fixed on the recording medium S.

The fixing nip portion is a pressure-contact nip portion of a fixing member 14*a* and a pressure member 14*b* of the fixing unit 14. After exiting the fixing unit 14, the recording medium S is discharged by the discharge roller pair 19 onto the discharge tray 20.

A secondary transfer residual toner remains on the surface of the belt 5 after the secondary transfer of the toner images onto the recording medium S. The secondary transfer residual toner is removed from the belt surface by the transfer belt cleaning device 23, and the cleaned belt surface is subjected to a next image forming process.

The toner removed by the transfer belt cleaning device 23 is passed through a waste toner conveyance path (not illustrated), and is conveyed to a waste toner collection container (not illustrated) to be collected. The waste toner collection container is disposed at a back surface portion of the image forming apparatus 100.

<<Process Cartridge>>

Figure 4A:
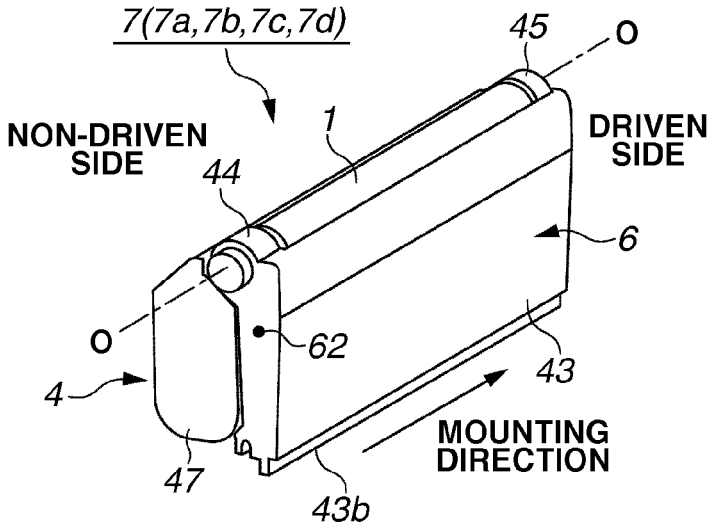
FIGS. 4A, 4B, and 4C are perspective views illustrating the process cartridge according to the first exemplary embodiment.
Figure 4B:
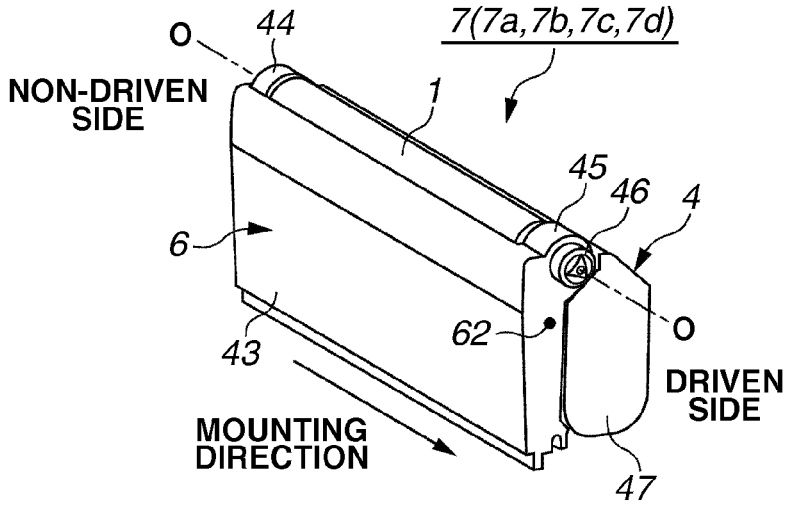
Figure 4C:
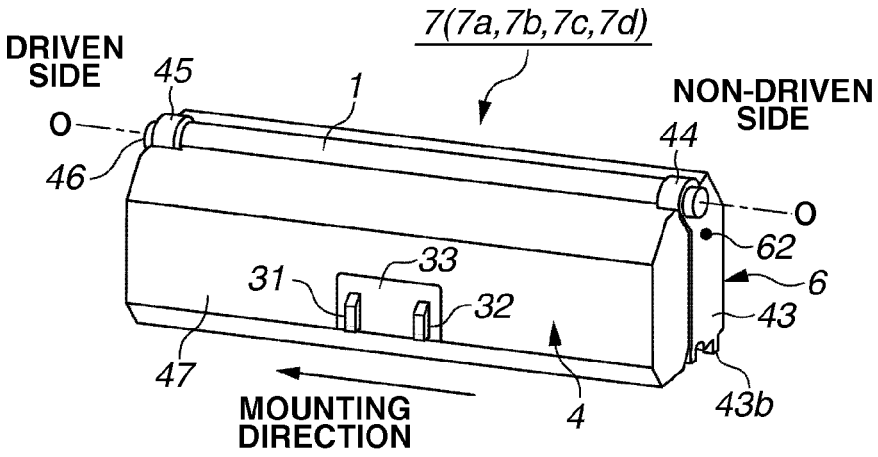
Figure 5:
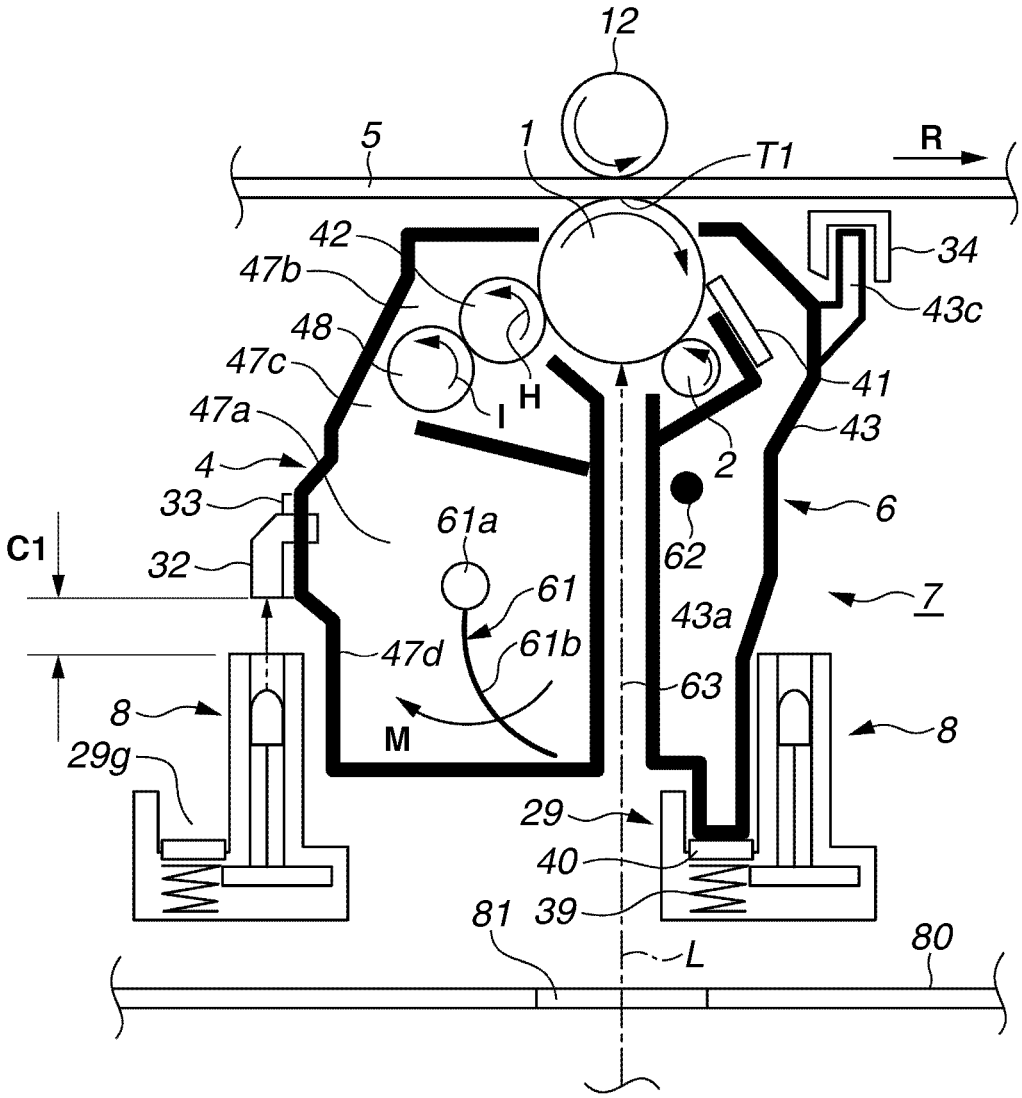
FIG. 5 is a cross-sectional view illustrating the process cartridge and the vicinity thereof according to the first exemplary embodiment.

The cartridge 7 according to the present exemplary embodiment will be described with reference to FIGS. 4 and 5. All of the cartridges 7 (7*a* to 7*d*) are configured in a similar manner except for the difference of the colors Y, M, C, and K of the toners contained in the toner containing chambers of the developing units 4. FIG. 4A is an external perspective view illustrating the cartridge 7 as viewed from the front side (a non-driven side) in a mounting direction. FIG. 4B is an external perspective view illustrating the cartridge 7 as viewed from the back side (a driven side) in the mounting direction. FIG. 4C is an external perspective view illustrating the cartridge 7 as viewed from the developing unit 4. FIG. 5 is a partial enlarged cross-sectional view illustrating the cartridge 7 and the vicinity of the cartridge 7 which is mounted at the position where image formation can be performed within the apparatus main body 100A.

The cartridge 7 is an assembly in which the longitudinal direction thereof corresponds to a direction O-O of the rotational axis of the drum 1. The cartridge 7 includes the photosensitive member unit 6 having the drum 1, the charging roller 2, the cleaning member 41, and the like, and the developing unit 4 having the developing roller 42 as a developer bearing member (a developing member) and the like.

The drum 1 is rotatably attached to a cleaning frame member 43 of the photosensitive member unit 6 via bearing members 44 and 45 at the front side and the back side. The charging roller 2 and the cleaning member 41 are disposed on the circumference of the drum 1. The charging roller 2 is in contact with the drum 1 pressed by a predetermined pressing force, and is configured to rotate according to a rotation of the drum 1. The cleaning member 41 is in contact with the drum 1 pressed by a predetermined pressing force. The residual toner removed from the surface of the drum 1 by the cleaning member 41 falls into a removed toner chamber 43*a*. A driving input coupling (a driving receiving unit) 46 is disposed at the end of the cleaning frame member 43 at the back side as viewed from the cartridge mounting direction.

A toner containing chamber (a developer containing portion) 47*a* and a developing chamber 47*b* are formed in the developing frame member 47 of the developing unit 4. The toner containing chamber 47*a* contains the toner (not illustrated), which is a developer. The developing roller 42 rotatable in a direction indicated by an arrow H in contact with the drum 1 is disposed in the developing chamber 47*b*. The developing chamber 47*b* is located at the upper side relative to the toner containing chamber 47*a*. The toner containing chamber 47*a* and the developing chamber 47*b* are in communication with each other via an opening 47*c* located above the toner containing chamber 47*a*. A toner supply roller 48 is disposed on the circumference of the developing roller 42. The toner supply roller 48 serves as a developer supply member rotatable in a direction indicated by an arrow I in contact with the developing roller 42.

A rotatably supported toner stirring member 61 is disposed in the toner containing chamber 47*a* to stir the contained toner and deliver the toner to the toner supply roller 48 in the developing chamber 47*b* via the opening 47*c*. The toner stirring member 61 includes a shaft member 61*a*, and a flexible resin stirring sheet 61*b* having an end attached to the shaft member 61*a* for stirring and conveying the toner. The toner stirring member 61 is rotationally driven at a predetermined speed in a direction indicated by an arrow M according to an image forming operation.

Further, light transmission members 31 and 32 for optically detecting a remaining toner amount are disposed on a wall surface 47*d*, in which the toner containing chamber 47*a* of the developing frame member 47 of each cartridge 7 is formed.

The developing frame member 47 of the developing unit 4 is coupled to the cleaning frame member 43 of the photosensitive member unit 6 rotatably around a support axis 62. Then, when the cartridge 7 forms an image, the developing unit 4 is rotatably biased in a direction causing the developing roller 42 to abut against the drum 1 around the support axis 62 by a thrust force of a pressure spring (not illustrated) disposed between the developing unit 4 and the photosensitive member unit 6. As a result, the developing roller 42 is held in abutment with the drum 1 by a predetermined pressing force. When the cartridge 7 does not form an image, the developing unit 4 is held in a rotating state rotated in a direction causing the developing roller 42 to move away from the drum 1 around the support axis 62 against the pressure spring (an abutment of the developing unit 4 on the drum 1 and a separation of the developing unit 4 from the drum 1).

A guide rib 43*b* is formed at the bottom of the cleaning frame member 43 along the longitudinal direction of the cleaning frame member 43 (FIG. 3). This guide rib 43*b* is configured to be engaged with a guide groove 82 of the front door 21 and a guide rail 29 in this order. A space portion between the photosensitive member unit 6 and the developing unit 4 serves as a slit opening 63 as the laser beam entry opening.

When the cartridge 7 is in a positioned state, in which the cartridge 7 is inserted into the mounting portion of the apparatus main body 100A in a predetermined manner and is mounted at the position allowing image formation, the top surface of the drum 1 is in contact with the bottom surface of the belt 5. Thus, the primary transfer portion T1 is formed. Further, a driving output coupling (a driving output unit: not illustrated) of the apparatus main body 100A is coupled to the driving input coupling 46. Transmission of a driving force from the driving output coupling to the driving input coupling 46 causes the drum 1, the developing roller 42, the toner supply roller 48, and the toner stirring member 61 to be respectively rotationally driven at predetermined speeds in predetermined rotational directions according to an image forming operation. Further, an output electric contact (not illustrated) of the apparatus main body 100A is electrically connected to an input electric contact (not illustrated) of the cartridge 7. When a predetermined bias is applied from the output electric contact to the input electric contact, the predetermined charging bias and the predetermined developing bias are respectively applied to the charging roller 2 and the developing roller 42 according to the image forming operation. Further, the slit opening 63 as the laser beam entry opening is aligned with the laser emission window 81 (81*a* to

81*d*) formed at the top surface plate 80 of the laser scanner unit 3. The laser beam L (La to Ld) output from the laser scanner unit 3 is introduced into the cartridge 7 from the slit opening 63 formed at the bottom of the cartridge 7, and is applied onto the bottom surface of the drum 1.

<<Process Cartridge Replacement Method>>

In the respective cartridges 7 mounted on the apparatus main body 100A, the toners contained in the toner containing chambers 47*a* of the developing units 4 are respectively consumed, as they are used for image formation. Therefore, remaining amount detection units (8, 31, and 32) for detecting the remaining toner amounts in the individual cartridges 7 are provided. Then, the control circuit unit A compares the remaining amount values detected by the remaining amount detection units with a preset threshold value for predicting and warning a cartridge lifetime. For the cartridge 7 in which the toner amount decreases to such an extent that the remaining amount value thereof falls below the threshold value, the control circuit unit A displays a lifetime prediction or a lifetime warning about that cartridge 7 on a display unit (not illustrated) of the operation unit C. This can prompt a user to prepare a replacement cartridge or prompt the user to replace the cartridge, thereby maintaining the quality of an output image.

The image forming apparatus 100 according to the present exemplary embodiment is configured such that the respective cartridges 7 are replaced in a front access manner by opening the door 21, which is the opening/closing member of the apparatus main body 100A, as illustrated in FIG. 3. The grip portion 21*a* is disposed at the front door 21.

An opening for allowing the cartridge 7 to pass therethrough to mount or detach the cartridge 7 is formed at a front-side frame 37, which is a framework of the apparatus main body 100A. In other words, the front-side frame 37 includes an opening for inserting the cartridge 7 into the cartridge mounting portion 22 in the apparatus main body 100A and pulling out the cartridge 7 from the cartridge mounting portion 22.

The door 21 is disposed at the apparatus main body 100A movably between a closing position where the door 21 covers and closes the opening, and an opening position where the door 21 opens the opening.

Figure 6A:
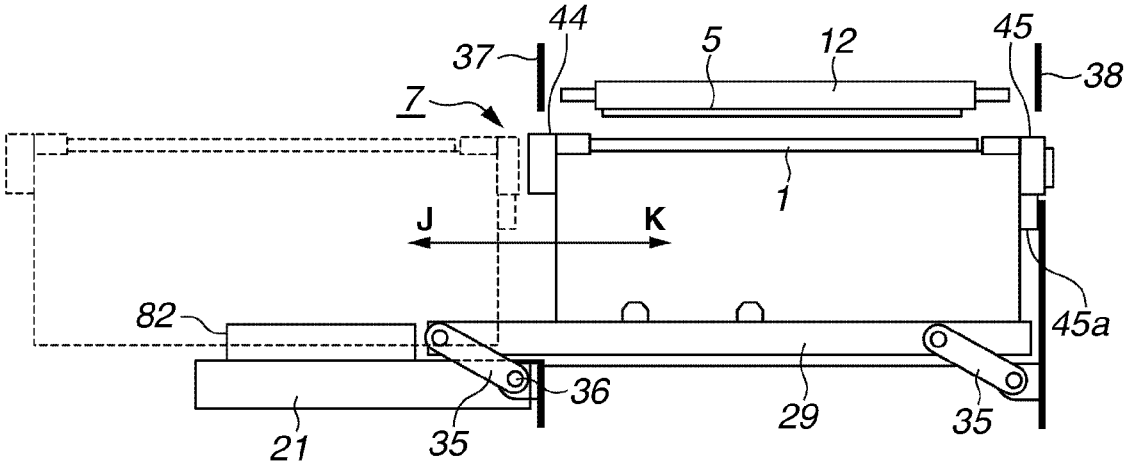
FIGS. 6A and 6B are sectional side views illustrating the process cartridge according to the first exemplary embodiment when the process cartridge is being mounted into an apparatus main body.
Figure 6B:
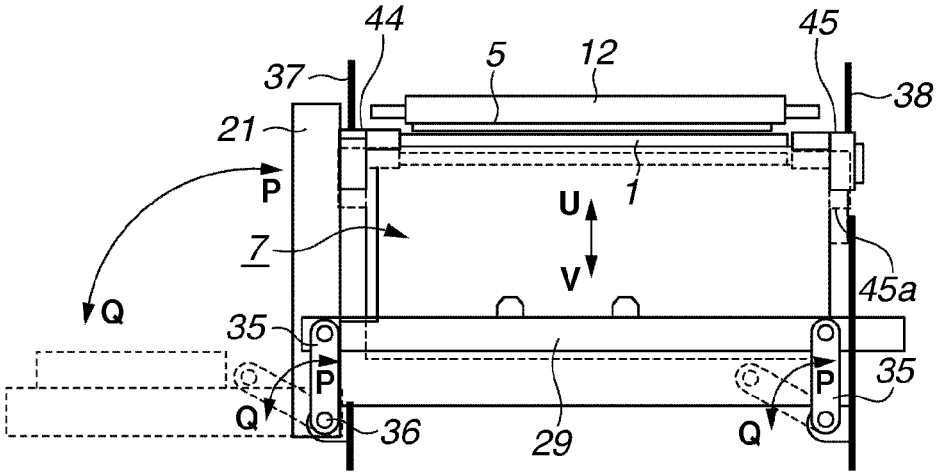

FIGS. 6A and 6B illustrate operations when the cartridge 7 is mounted on and detached from the apparatus main body 100A. FIG. 6A illustrates an operation when the cartridge 7 is mounted on and detached from the apparatus main body 100A by sliding in the longitudinal direction of the cartridge 7. FIG. 6B illustrates an operation when the cartridge 7 is moved between an image forming position and a position for detachably mounting the cartridge 7 on the apparatus main body 100A, in conjunction with opening/closing of the door 21.

When the door 21 is opened around a rotational shaft 36 as illustrated in FIG. 6B, first to fourth rotational arms 35 rotate in directions indicated by arrows Q in FIG. 6B, in conjunction with the rotation of the rotational shaft 36. The guide rail 29 (a moving member) pivotally supported by the rotational arms 35 performs a link-rotation to reach the position illustrated in FIG. 6A around the rotational shafts 36 and a rotational center 38*a* provided at the back-side frame 38. As a result, each of the cartridges 7 in the apparatus main body 100A moves from the image forming position to the mounting/detachment position in a direction indicated by an arrow V. In this manner, the guide rail 29 moves downwardly, so that the cartridge 7 supported by the guide rail 29 moves from the image forming position to the mounting/detachment position. Next, while the cartridge 7 that should be replaced is pulled to the frontward direction illustrated by an arrow J, the guide rib 43*b* formed at the bottom of the cleaning frame member 43 is inserted from an guide groove 29*g* of the guide rail 29 (29*a* to 29*d*) to the guide groove 82 (82*a* to 82*d*) of the door 21. Then, the cartridge 7 continues to slide to the front side to be pulled out from the apparatus main body 100A.

Next, a procedure for inserting a new cartridge 7 into the apparatus main body 100A via the opening by inserting the cartridge 7 with its driven side in front will be described. First, the guide rib 43*b* formed at the bottom of the cleaning frame member 43 is inserted along the guide groove 82 of the door 21. Subsequently, the guide rib 43*b* is connected to the guide rail 29, and the cartridge 7 is moved in the backward direction indicated by an arrow K to be pushed in until an abutment portion 45*a* provided at the bearing member 45 at the back side of the cartridge 7 abuts on the back-side frame 38. After all of the cartridges 7 that should be replaced are replaced with new ones, the door 21 is closed. The rotational arms 35 rotate in directions indicated by arrows P in conjunction with this closing operation of the door 21. The guide rail 29 is raised along with the rotations of the rotational arms 35. The guide rail 29 moves upwardly in this manner, so that each of the cartridges 7 in each cartridge mounting portion 22 within the apparatus main body 100A moves in a direction indicated by an arrow U (a first direction) from the position for detachably mounting the cartridge 7 on the apparatus main body A to the position for forming an image. At this time, the cartridge 7 is pressed by a cartridge pressure spring 39 disposed at the guide rail 29 as illustrated in FIG. 5, to be positioned at positioning portions (not illustrated) of the front-side frame 37 and the back-side frame 38.

<<Configuration for Detecting Remaining Toner Amount>>

Figure 7:
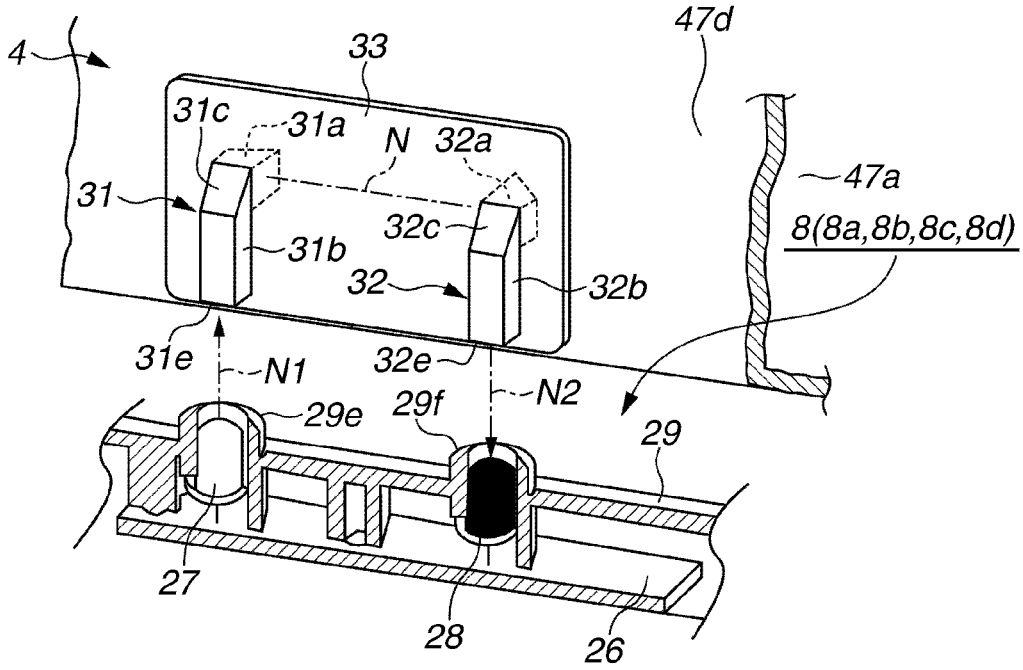
FIG. 7 is a cross-sectional perspective view illustrating a detection unit and light transmission members according to the first exemplary embodiment.
Figure 8A:
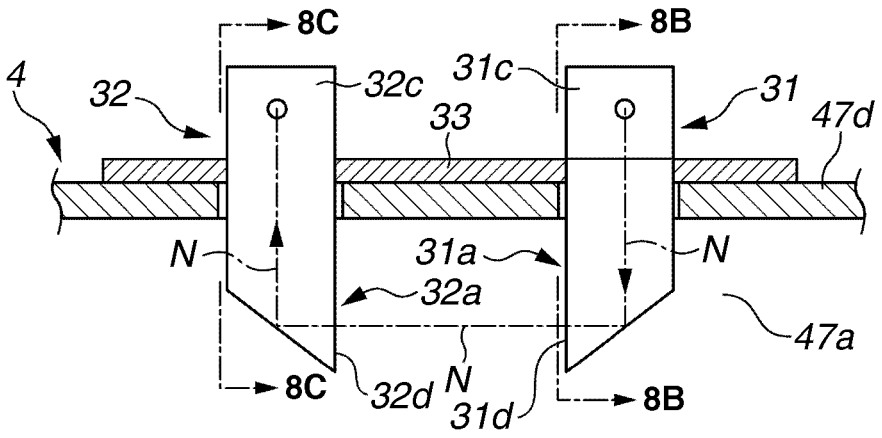
FIGS. 8A, 8B, and 8C are cross-sectional explanatory views illustrating the detection unit and the light transmission members according to the first exemplary embodiment.
Figure 8B:
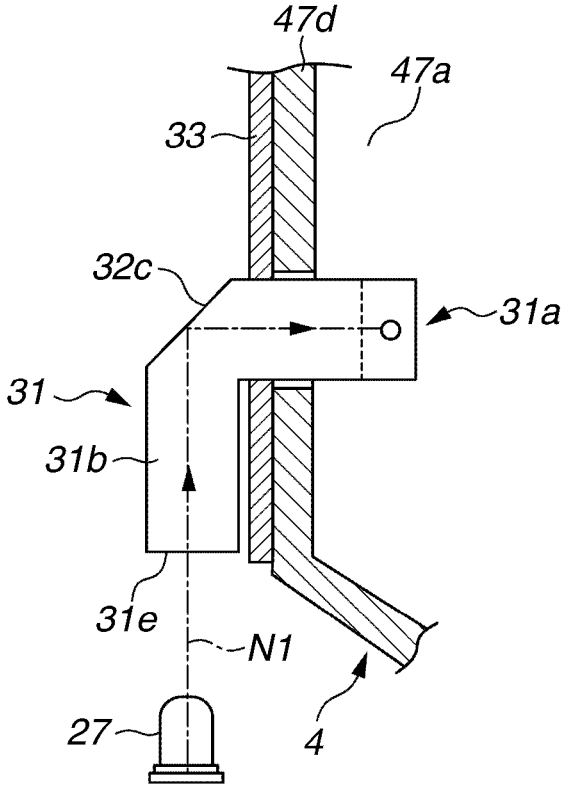
Figure 8C:
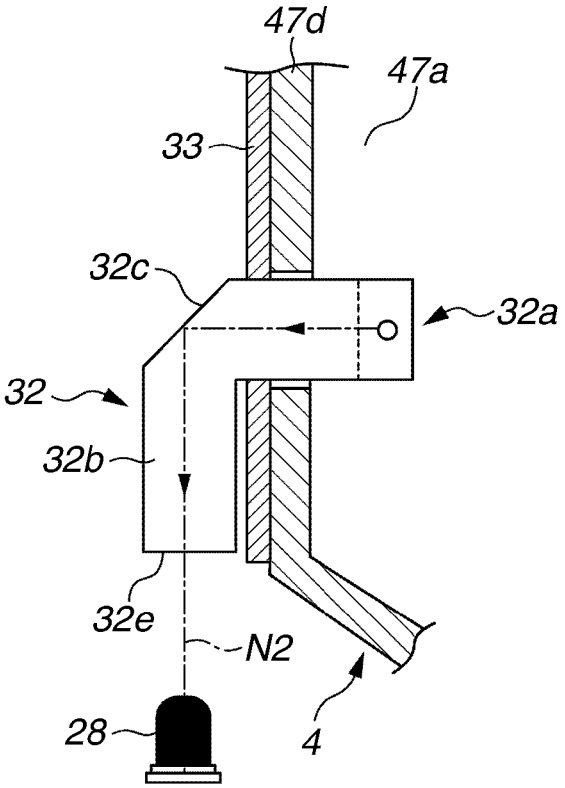

A configuration for detecting the remaining amount of the toner contained in the developing unit 4 of each cartridge 7 (7*a* to 7*d*) will be described with reference to FIGS. 5, 7, and 8. FIG. 7 is a perspective view illustrating the light transmission members 31 and 32, and the detection unit 8. FIG. 8A is a top view illustrating the light transmission members 31 and 32. FIG. 8B is a cross-sectional view taken along a line (b)-(b) illustrated in FIG. 8A. FIG. 8C is a cross-sectional view taken along a line (c)-(c) illustrated in FIG. 8A. At each cartridge 7, the pair of light transmission members 31 and 32 is oppositely disposed on the wall surface 47*d*, which forms the toner containing chamber 47*a* of the developing unit 4, along the longitudinal direction of the developing roller 42. The light transmission members 31 and 32 are attached to the wall surface 47*d* of the toner containing chamber 47*a* via a support member 33. The light transmission member 31 includes a transmission window 31*a* as an output portion from which detection light is output. The light transmission member 32 includes a transmission window 32*a* as an entry portion through which the detection light enters. These two transmission windows 31*a* and 32*a* protrude into the toner containing chamber 47*a* of the developing unit 4.

The light transmission member 31 is formed by integrating the above-described transmission window 31*a* and a light guide 31*b*. The light guide 31*b* is a member that guides into the toner containing chamber 47*a* detection light N (N1) emitted from a light emitting element 27 (for example, a light emitting diode (LED)), which is disposed at the apparatus main body 100A and is configured to emit light.

The light transmission member 32 is formed by integrating the above-described transmission window 32*a* and a light guide 32*b*. The light guide 32*b* is a member that guides the detection light N (N2) transmitted through the interior of the toner containing chamber 47*a* to a light receiving element 28

(for example, a phototransistor), which is disposed at the apparatus main body 100A. In the present exemplary embodiment, the light emitting element 27 and light receiving element 28 constitute the detection unit 8 for detecting the remaining toner amount in the developing unit 4.

Further, a light exit surface 31*d* of the transmission window 31*a* is located to face a light entry surface 32*d* of the transmission window 32*a* of the light transmission member 32. A reflection surface 32*c* is formed at the light guide 32*b* of the light transmission member 32 so that the light N incident from the light entry surface 32*d* of the transmission window 32*a* is guided to the light receiving element 28. A light entry surface 31*e* of the light transmission member 31 is provided so as to face the light emitting element 27 so that the detection light from the light emitting element 27 is incident thereon. A light exit surface 32*e* of the light transmission member 32 is provided so as to face the light receiving element 28 so that the detection light N transmitted through the light guide 32*b* is detected by the light receiving element 28.

On the other hand, the light emitting element 27, which emits the detection light N, and the light receiving element 28, which receives the detection light N from the light emitting element 27, are held by the guide rail 29. The light emitting element 27 and the light receiving element 28 are configured integrally with a circuit board 26, and are attached to the guide rail 29. The guide rail 29 is attached to the rotational arms 35 as described above.

As illustrated in FIG. 5, the toner stirring member 61 is rotationally driven at the predetermined speed in the direction indicated by the arrow M according to an image forming operation, such that the toner in the toner containing chamber 47*a* is stirred and conveyed while being lifted up along the inner wall surface of the toner containing chamber 47*a*. Then, a part of the stirred and conveyed toner is introduced into the developing chamber 47*b* via the opening 47*c* to be used for image formation. The toner contained in the toner containing chamber 47*a* reduces as it is sequentially transferred into the developing chamber 47*b* to be used for image formation.

On the other hand, when the toner exists between the transmission windows 31*a* and 32*a* protruding in the toner containing chamber 47*a*, the detection light N emitted from the light emitting element 27 is blocked, and the detection light N is not received by the light receiving element 28. On the other hand, when the toner does not exist between the transmission windows 31*a* and 32*a*, the detection light N emitted from the light emitting element 27 is not blocked, and is received by the light receiving element 28. The state in which the toner exists between the transmission windows 31*a* and 32*a*, and the state in which the toner does not exist between the transmission windows 31*a* and 32*a* are alternately created due to a flow of the toner generated by a rotation of the toner stirring member 61 according to an image forming operation. As the toner amount reduces in the toner containing chamber 47*a*, the detection light N is blocked for a shorter time. Conversely, the reduction in the toner amount brings about such a phenomenon that the detection light N is transmitted for a longer time. Accordingly, the control circuit unit A estimates the remaining toner amount in the toner containing chamber 47*a* by utilizing the phenomenon that the time during which the detection light is blocked and the time during which the detection light is transmitted, which are detected by the light receiving element 28, change according to the toner amount because of the flow of the toner generated by the rotation of the toner stirring member 61. Then, the control circuit unit A compares this estimated remaining toner amount with a predetermined threshold value, and displays a lifetime prediction or a lifetime warning about the subject cartridge 7 on the display unit of the operation unit C.

As described above, the light emitting element 27 and the light receiving element 28 for detection of the remaining amount are disposed below the light transmission members 31 and 32 at a substantially central position in the width of the recording medium S (the paper width) to detect the remaining amount of the toner contained in the developing unit 4 of each of the cartridges 7 (7*a* to 7*d*).

In the present exemplary embodiment, light emitting holding portions 29*e*, which are formed integrally with the respective guide rails 29 (29*a*, 29*b*, and 29*c*), hold the respective light emitting elements 27 of the detection units 8 (8*b*, 8*c*, and 8*d*). Similarly, light receiving holding portions 29*f*, which are formed integrally with the respective guide rails 29, hold the respective light receiving elements 28. More specifically, the guide rail 29*a* for moving the cartridge 7*a* to the image forming position holds the detection unit 8*b* for detecting the remaining toner amount in the cartridge 7*b*. Further, the guide rail 29*b* for moving the cartridge 7*b* to the image forming position holds the detection unit 8*c* for detecting the remaining toner amount in the cartridge 7*c*. Further, the guide rail 29*c* for moving the cartridge 7*c* to the image forming position holds the detection unit 8*d* for detecting the remaining toner amount in the cartridge 7*d*. Further, because there is no cartridge adjacent to the detection unit 8*a* on the left side thereof, so that the guide rail 29 is unnecessary here, the detection unit 8*a* for the cartridge 7*a* is held by a detection holder 55 (refer to FIG. 1) and is configured so as to be raised and lowered by a link mechanism similar to the guide rail 29. Further, because there is no cartridge adjacent to the guide rail 29*d* at the right side thereof, the detection unit 8 is not provided on the guide rail 29*d*.

Figure 14A:
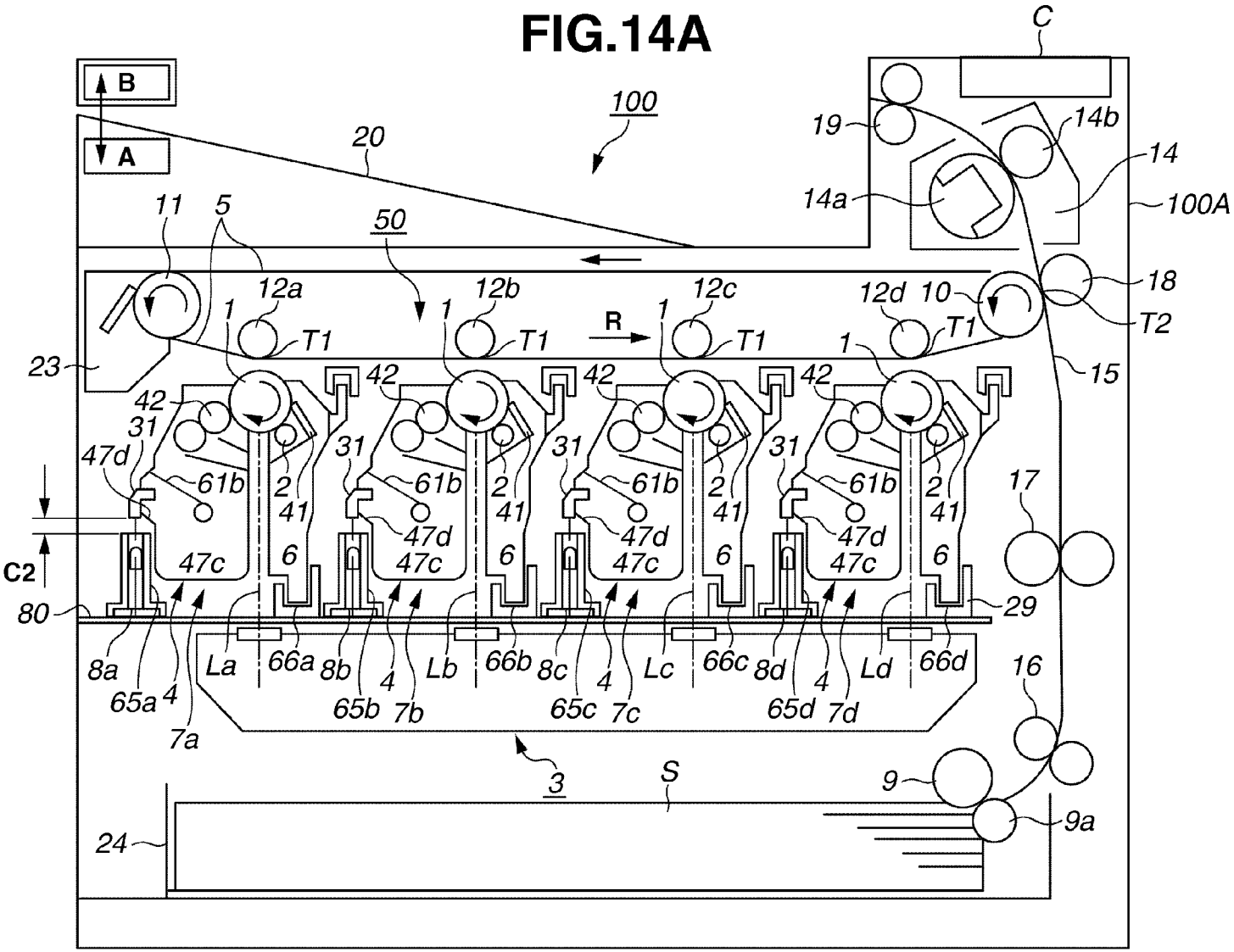
FIGS. 14A and 14B are cross-sectional views illustrating a conventional image forming apparatus.
Figure 14B:
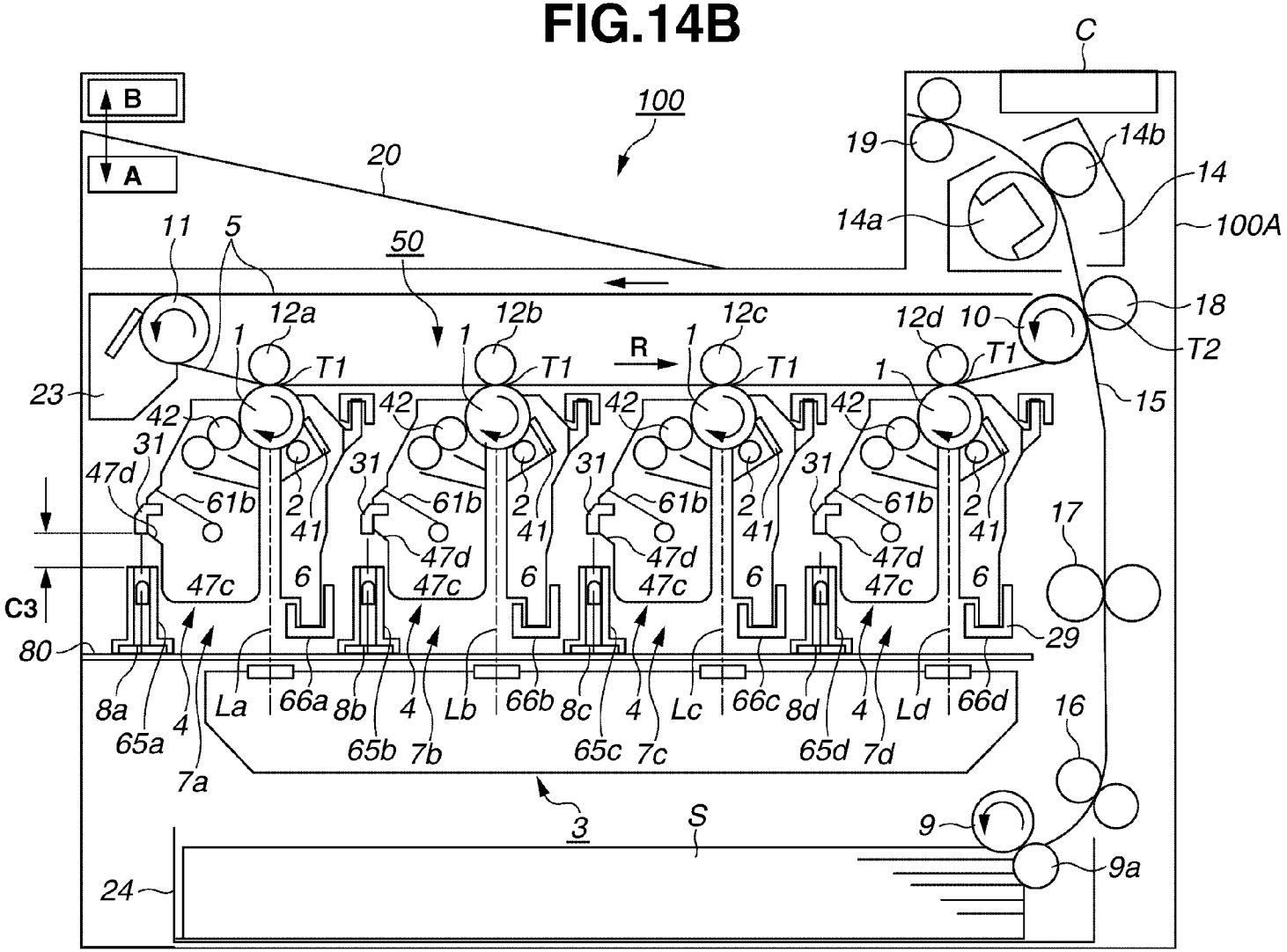

Now, the configuration according to the present exemplary embodiment will be compared to the conventional configuration illustrated in FIG. 14.

According to the conventional configuration illustrated in FIG. 14, the guide rail 29 configured to be raised and lowered, and the detection unit 8 fixedly attached to the top surface plate of the main body are disposed side by side as separate different structures. This conventional configuration requires a certain space to prevent the guide rail 29 supposed to be raised and lowered and a structure holding the detection unit 8, from contacting each other. Further, in addition to the width of the guide rail 29, the conventional configuration requires the widths of the light emitting element 27 and the light receiving element 28, and the width of the light receiving holding portion 29*f*. The light receiving holding portion 29*f* is disposed to cover the whole circumference of the light receiving element 28 to prevent direct scattering light or indirect reflected light from the light emitting element 27, from entering the light receiving element 28. Conventionally, the distance between the cartridges 7 is determined based on these space and widths. Further, in tandem type image forming apparatuses, the increase in the size of the image forming apparatus main body in the direction of cartridge arrangement, leads to increases in the sizes of the intermediate transfer belt unit 50, the laser scanner unit 3, and the like according to the size in the direction of the cartridge arrangement. As a result, the size of the image forming apparatus main body increases significantly. Further, the increase in the size of the image forming apparatus main body in the direction of cartridge arrangement leads to increases in the sizes of the transfer belt unit and the laser scanner unit which work on the plurality of cartridges, in that direction.

On the other hand, the present exemplary embodiment is configured in such a manner that the guide rail 29 holds the detection unit 8, and therefore does not require the above-described certain space. Further, the light emitting element 27, the light receiving element 28, and the structure holding the light receiving element 28 are also integrally configured as the structure width of the guide rail 29, which allows minimization of the sizes of the structures unrelated to the size of the cartridge 7 in the left-right direction. Therefore, the distance between the adjacent cartridges 7 can reduce, realizing a reduction in the size of the image forming apparatus 100 in the direction of cartridge arrangement (the left-right direction). Further, the present exemplary embodiment can also realize reductions in the sizes of the transfer belt unit 50 and the laser scanner unit 3 that work on the plurality of cartridges 7 in the direction cartridge arrangement. As a result, the present exemplary embodiment can achieve miniaturization and a cost reduction of the image forming apparatus main body 100A.

Figure 10:
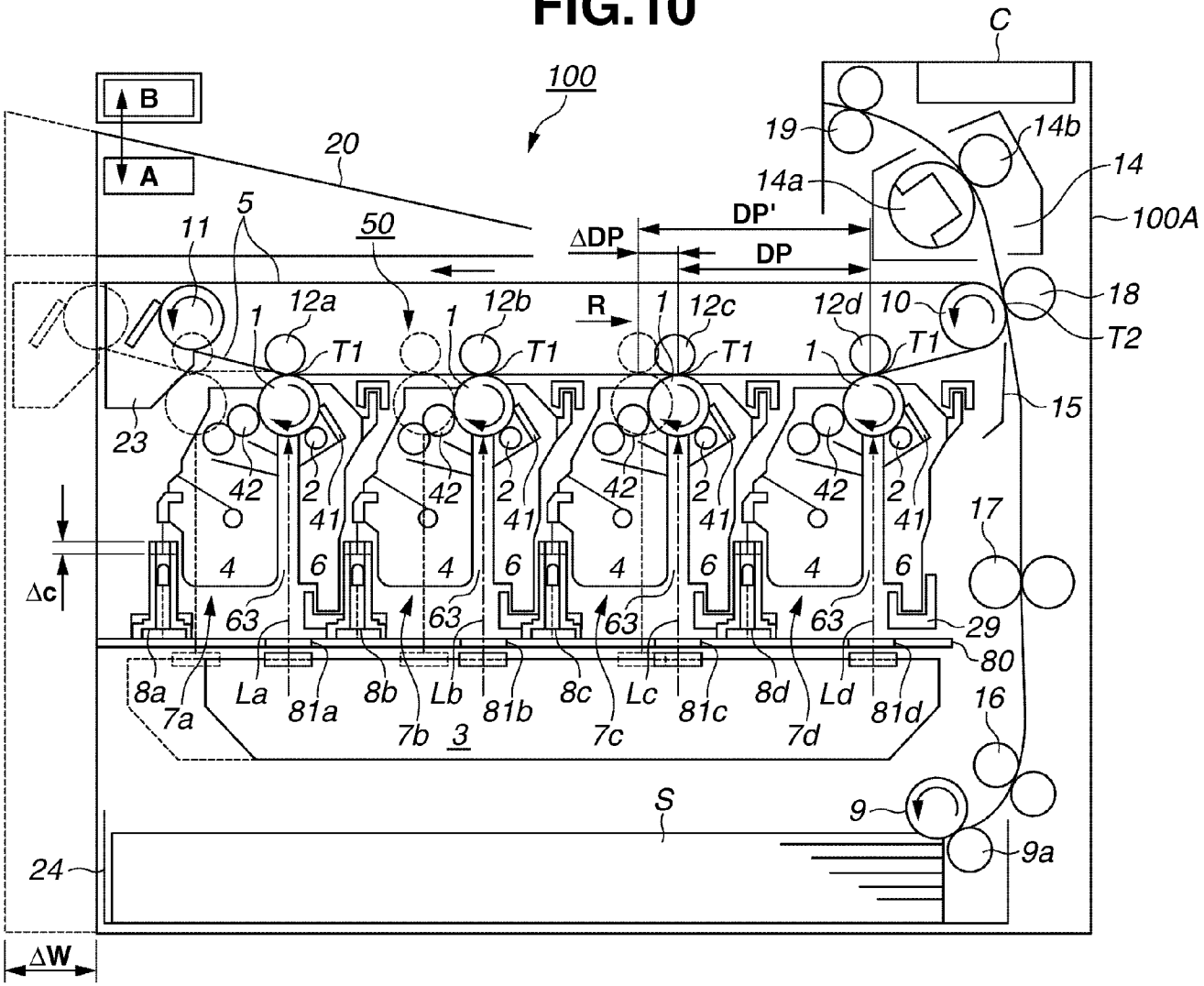
FIG. 10 is a cross-sectional view illustrating a comparison between the size of the configuration of the first exemplary embodiment and the size of a conventional configuration.

FIG. 10 is a cross-sectional view illustrating a comparison in size between the configuration according to the present exemplary embodiment and the conventional configuration. In FIG. 10, the broken line indicates the cross section of main parts of the conventional image forming apparatus, and the solid line indicates the cross section of the present exemplary embodiment.

As illustrated in FIG. 10, an arrangement distance DP between the adjacent cartridges 7 is shorter than a conventional arrangement distance DP' by a distance ΔDP. Therefore, because four cartridges are arranged in the present exemplary embodiment, the size of the main body in the left-right direction reduces by the reduction distance ΔDP multiplied by three, i.e., a distance ΔW illustrated in FIG. 10.

As illustrated in FIG. 6, the guide rail 29 is a rail configured to be raised and lowered in a swinging manner, and the position of the detection unit 8 in the front-back direction changes between the position of the guide rail 29 when the guide rail 29 is raised and the position of the guide rail 29 when the guide rail 29 is lowered. Therefore, the image forming apparatus 100 is configured such that, in the position where the guide rail 29 is raised at the time of image formation, i.e., in the position where the detection unit 8 detects the remaining toner amount, the light transmission members 31 and 32 of the cartridge 7 are located on the optical path of the detection light N from the detection unit 8.

Further, as described above, the developing unit 4 of the cartridge 7 performs the abutment operation and the separation operation relative to the drum 1 around the support shaft 62. Therefore, as illustrated in FIG. 5, the positions of the light emitting element 27 and the light receiving element 28 are aligned with the light transmission members 31 and 32 in the left-right direction when the developing unit 4 is in abutment with the drum 1.

Figure 9:
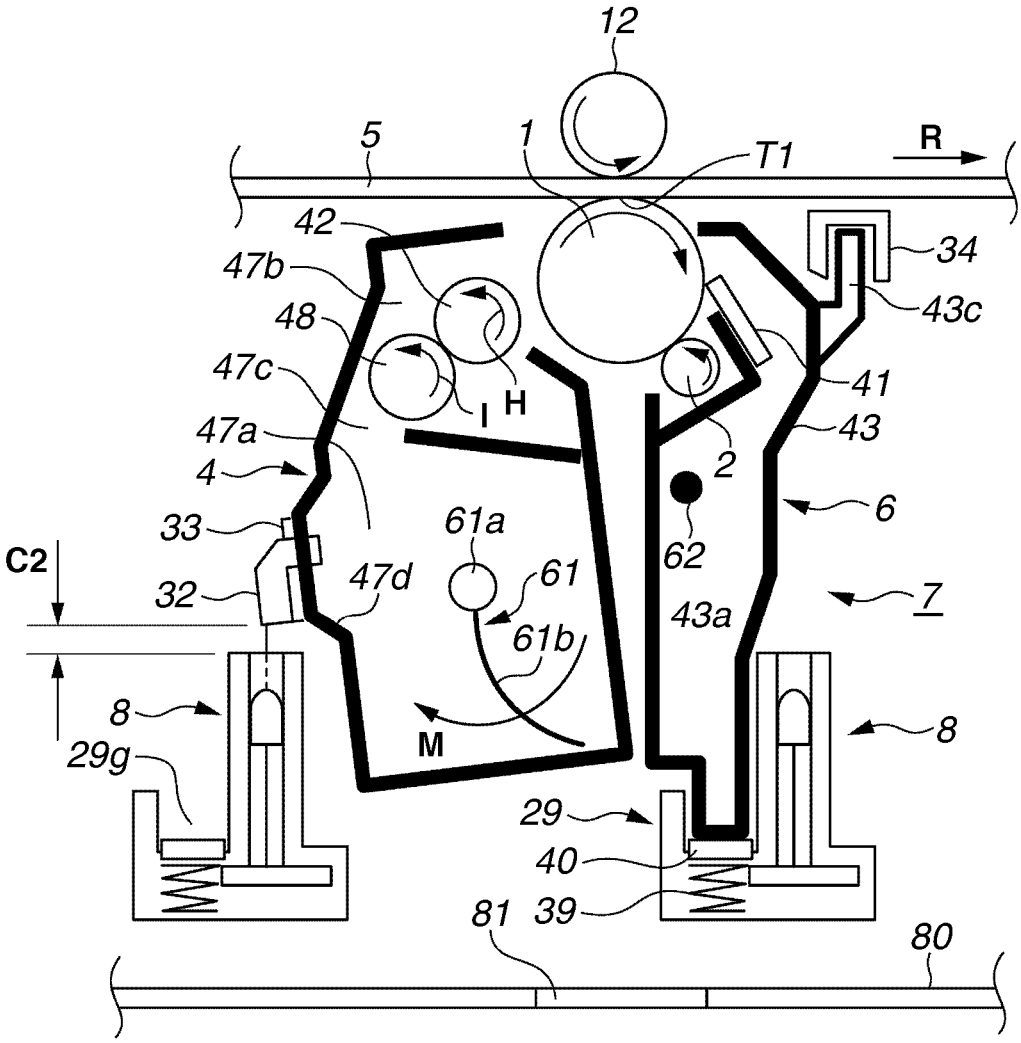
FIG. 9 is a cross-sectional view illustrating the process cartridge and the vicinity thereof according to the first exemplary embodiment.

On the other hand, as illustrated in FIG. 9, when the developing unit 4 performs the separation operation relative to the drum 1 around the support shaft 62, the light transmission members 31 and 32 approach the light emitting holding portion 29*e* and the light receiving holding portion 29*f* of the guide rail 29 only as far as a predetermined minimum distance C2 which prevents contact therebetween.

Therefore, the distance C1 between the light transmission members 31 and 32 and the light emitting holding portion 29*e* and the light receiving holding portion 29*f* of the guide rail 29 at the time of an operation of inserting/pulling out the cartridge 7 and in the image forming state, is set to a distance in which the predetermined distance C2 and a distance corresponding to a rotation amount when the developing unit 4 performs the separation operation, are secured.

Normally, a light leak occurs between the light emitting element 27 and the light entry surface 31*e* of the light guide 31*b* of the first light transmission member 31. Further, a light leak occurs between the light receiving element 28 and the light exit surface 32*e* of the light guide 32*b* of the second light transmission member 32. These light leaks may prevent accurate detection of the remaining toner amount in the developing unit 4. Therefore, it is desirable to reduce the distance C1 between the light emitting element 27 and the light entry surface 31*e* of the light guide 31*b*, and the light receiving element 28 and the light exit surface 32*e* of the light guide 32*b* as much as possible.

Further, the detection unit 8 and the light transmission members 31 and 32 may be misaligned with each other in the left-right direction of the main body, causing a detection failure. Especially, this may be caused by a tilt in the installation of the light emitting element 27 and the light receiving element 28, a positional variation of the abutment state of the developing unit 4, and the like. If a tilt error is generated in the light transmission members 31 and 32, increasing the distance C leads to an increase in misalignment of the optical axes of the light transmission members 31 and 32 relative to the light emitting element 27 and the light receiving element 28 in the left-right direction. This is also a reason why it is desirable to reduce the distance C1 between the light emitting element 27 and the light entry surface 31*e* of the light guide 31*b*, and the distance C1 between the light receiving element 28 and the light exit surface 32*e* of the light guide 32*b* as much as possible.

In the present exemplary embodiment, the first to fourth guide rails 29 (29*a*, 29*b*, 29*c*, and 29*d*), which are raised and lowered at the same time as the first to fourth cartridges 7 (7*a*, 7*b*, 7*c*, and 7*d*), hold the detection units (8*b*, 8*c*, and 8*d*). The light entry surface 31*e* of the light guide 31*b* is located at the downstream side of the light emitting element 27 in the U direction, and the light exit surface 32*e* of the light guide 32*b* is located at the upstream side of the light receiving element 28 in the U direction. Therefore, even when the guide rail 29 is raised, no change occurs in the distance C1 between the light entry surface 31*e* and the light emitting element 27, and the distance C1 between the light exit surface 32*e* and the light receiving element 28, so that the distance C1 can reduce compared to the conventional configuration. In other words, compared to the conventional configuration in which the detection unit 8 is fixedly attached on the top surface plate 80 as a different structure from the guide rail 29, the detection unit 8 and the light transmission members 31 and 32 can be located closer to each other by a distance corresponding to a movement amount Δc (refer to FIG. 10) of an upward movement of the cartridge 7. As a result, it is possible to improve the accuracy of the detection of the remaining toner amount.

Next, a second exemplary embodiment of the image forming apparatus will be described with reference to FIGS. 11, 12, and 13. Components in the configuration of the second exemplary embodiment similar to the first exemplary embodiment will be identified by the same reference numerals, and will not be described in detail repeatedly.

In the first exemplary embodiment, the guide rails 29*a* to 29*c* for moving the cartridges 7*a* to 7*c* to the image forming positions are configured to hold the light emitting elements 27 and the light receiving elements 28 for detecting the remaining toner amounts in the cartridges 7*b* to 7*d*. On the other hand, in the present exemplary embodiment, the guide rails 29*a* to 29*c* for moving the cartridges 7*a* to 7*c* to the image forming positions are configured to hold the light emitting elements 27 for detecting the remaining toner amounts in the cartridges 7*b* to 7*d*. Further, the guide rails 29*a* to 29*c* are configured to hold the light receiving elements 28 for detecting the remaining toner amounts in the cartridges 7*a* to 7*c*.

In the following description, the specific configuration will be described with reference to the drawings.

Figure 11A:
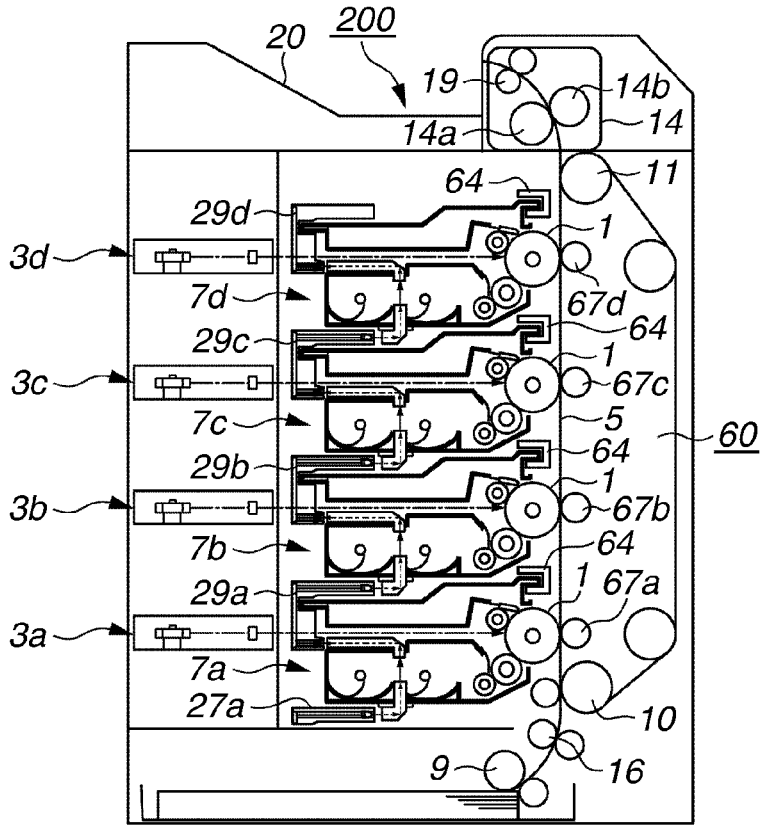
FIGS. 11A and 11B are cross-sectional views illustrating an image forming apparatus according to a second exemplary embodiment.
Figure 11B:
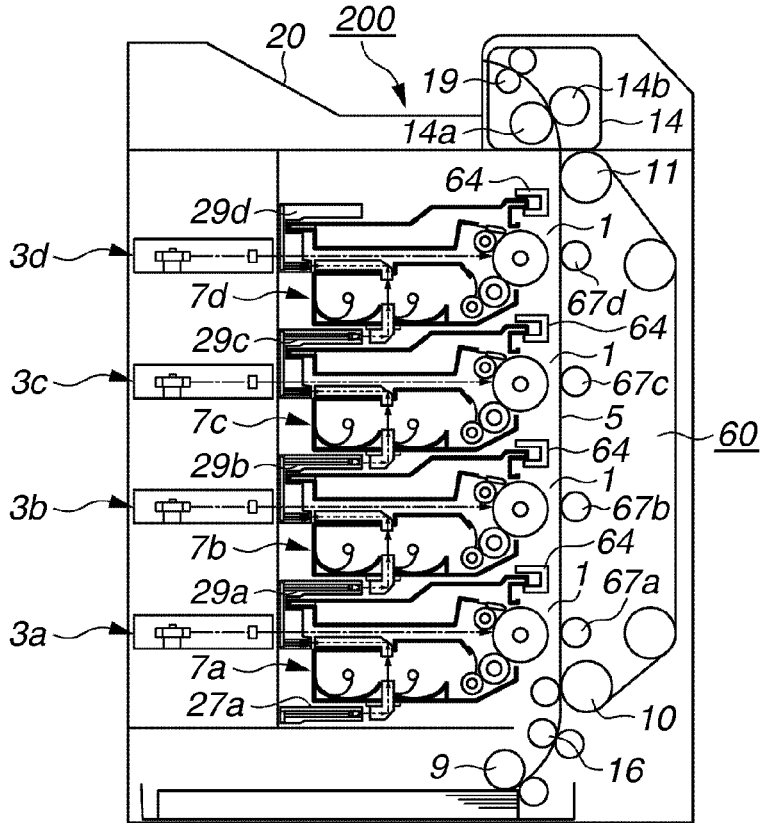
Figure 12:
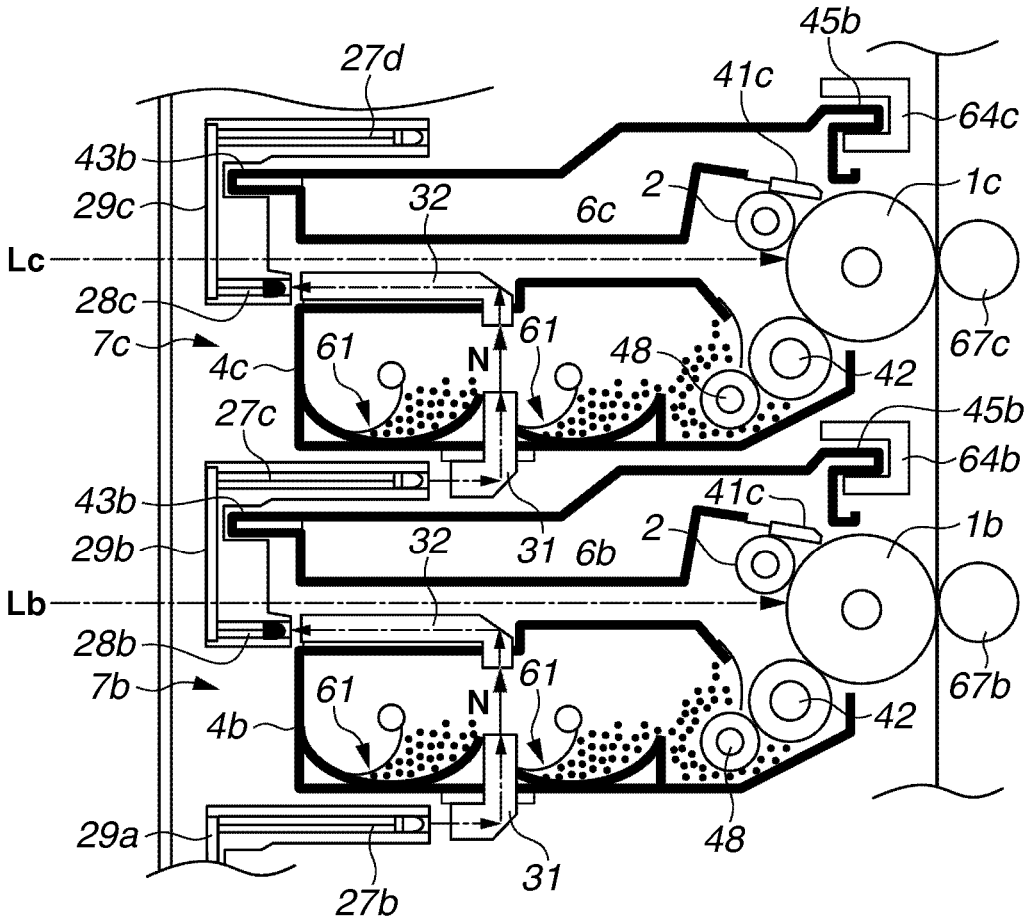
FIG. 12 is a cross-sectional view illustrating a process cartridge and the vicinity thereof according to the second exemplary embodiment.

FIGS. 11A and 11B are main cross-sectional views illustrating an image forming apparatus 200 according to the second exemplary embodiment. Further, FIG. 12 is a detailed cross-sectional view illustrating the cartridges 7 and the vicinity thereof according to the second exemplary embodiment. FIG. 13 is an external perspective view illustrating the image forming apparatus 200 according to the second exemplary embodiment.

FIG. 11A is a cross-sectional view illustrating the second exemplary embodiment in an image forming state. FIG. 11B is a cross-sectional view illustrating the image forming apparatus 200 according to the second exemplary embodiment with the transfer belt 5 and the drums 1 spaced apart from each other when the cartridges 7 are replaced.

The second exemplary embodiment is configured such that the plurality of cartridges 7 as image forming units is arranged vertically (in the direction of gravitational force). Further, the toners of the respective cartridges 7 are transferred onto the recording medium S inserted into transfer portions formed by the contact portions between the belt 5 of a conveyance belt unit 60 and the drums 1 of the cartridges 7.

Further, the scanner unit 3 is constituted by individual scanner units 3 (3*a*, 3*b*, 3*c*, and 3*d*) corresponding to the respective cartridges 7, and emits laser to the respective drums 1.

Next, an outline of an operation for forming a full-color image will be described. However, similar operations to the first exemplary embodiment will not be described in detail. The recording medium S fed by the feeding roller 9 is conveyed by the conveyance roller pair 16, and is conveyed to the belt 5 of the conveyance belt unit 60 and the drum 1*a* at predetermined control timing. The Y-color toner is transferred onto the recording medium S by the cartridge 7*a*. Then, the M-color toner, the C-color toner, and the K-color toner are sequentially transferred and superimposed on the recording medium S in the cartridges 7*b*, 7*c*, and 7*d*. The recording medium S with the toners transferred thereon is conveyed from the conveyance belt unit 60 to the fixing unit 14, and is discharged onto the discharge tray 20 by the discharge roller pair 19 after the fixing process.

Now, the configurations of the cartridge 7 and the detection unit according to the second exemplary embodiment will be described with reference to FIG. 12. FIG. 12 is a cross-sectional view, focusing on the portion corresponding to the cartridge 7*b* and the cartridge 7*c*. The cartridge 7 is formed by integrating the photosensitive member unit 6 and the developing unit 4 in a similar manner to the first exemplary embodiment. The photosensitive member unit 6 is configured in an approximately similar manner to the first exemplary embodiment. The developing unit 4 includes two toner containing chambers. The developing unit 4 also includes stirring members 61 in the respective toner containing chambers, thereby stirring the toner and supplying the toner to the developing roller 42. The method for detecting the remaining toner amount in the toner containing chamber is also similar to the first exemplary embodiment. By this method, the time during which the optical path is blocked by the toner passing between the sensor optical path formed by the two light transmission members 31 and 32 is measured to estimate the remaining toner amount.

The light emitting elements 27*b* to 27*d* are disposed at the guide rails 29*a* to 29*c* for the cartridges 7*a* to 7*c* adjacent to the detection target cartridges in this order. The light receiving elements 28*a* to 28*d* are disposed at the guide rails 29*a* to 29*d* for the detection target cartridges 7*a* to 7*d*. More specifically, the light emitting element 27*b* for optically detecting the remaining toner amount in the cartridge 7*b*, and the light receiving element 28*a* for optically detecting the remaining toner amount in the cartridge 7*a* are disposed at the guide rail 29*a* for moving the cartridge 7*a* to the image forming position. Further, the light emitting element 27*c* for detecting the remaining toner amount in the cartridge 7*c*, and the light receiving element 28*b* for detecting the remaining toner amount in the cartridge 7*b* are disposed at the guide rail 29*b* for moving the cartridge 7*b* to the image forming position. Further, the light emitting element 27*d* for detecting the remaining toner amount in the cartridge 7*d*, and the light receiving element 28*c* for detecting the remaining toner amount in the cartridge 7*c* are disposed at the guide rail 29*c* for moving the cartridge 7*c* to the image forming position.

The light transmission member 31 and the light transmission member 32 are respectively disposed at one end side and the other end side of the developing unit 4 of each cartridge 7 in the arrangement direction in which the cartridges 7 are arranged in a tandem manner. The exit surface of the light transmission member 31 and the entry surface of the light transmission member 32 face each other in the toner containing chamber of the developing unit 4. Further, light emitted from the light emitting element 27*b* held by the guide rail 29*a* is incident on the light transmission member 31 of the cartridge 7*b*, and light output from the light transmission member 32 of the cartridge 7*b* is received by the light receiving element 28 held by the guide rail 29*b*.

Figure 13A:
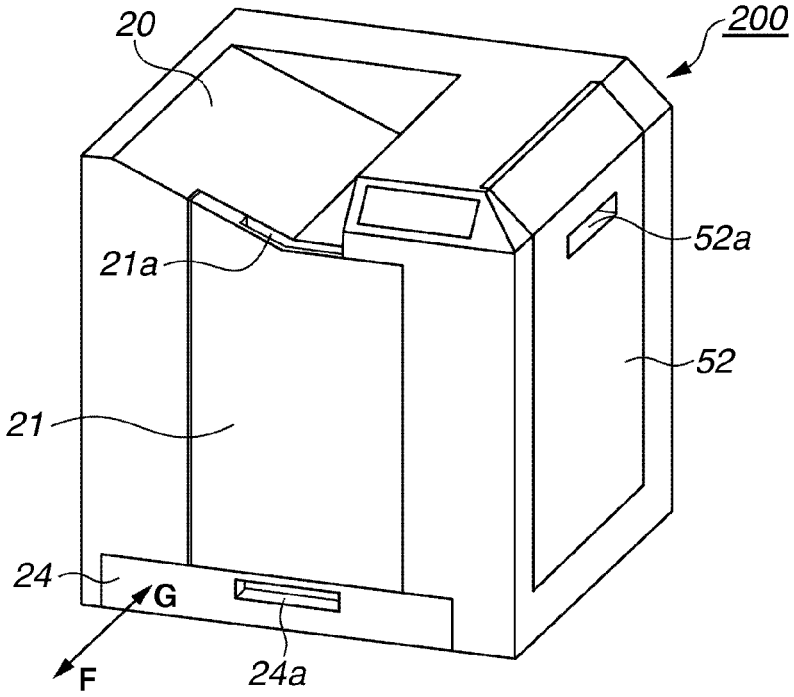
FIGS. 13A and 13B are perspective views illustrating the image forming apparatus according to the second exemplary embodiment.
Figure 13B:
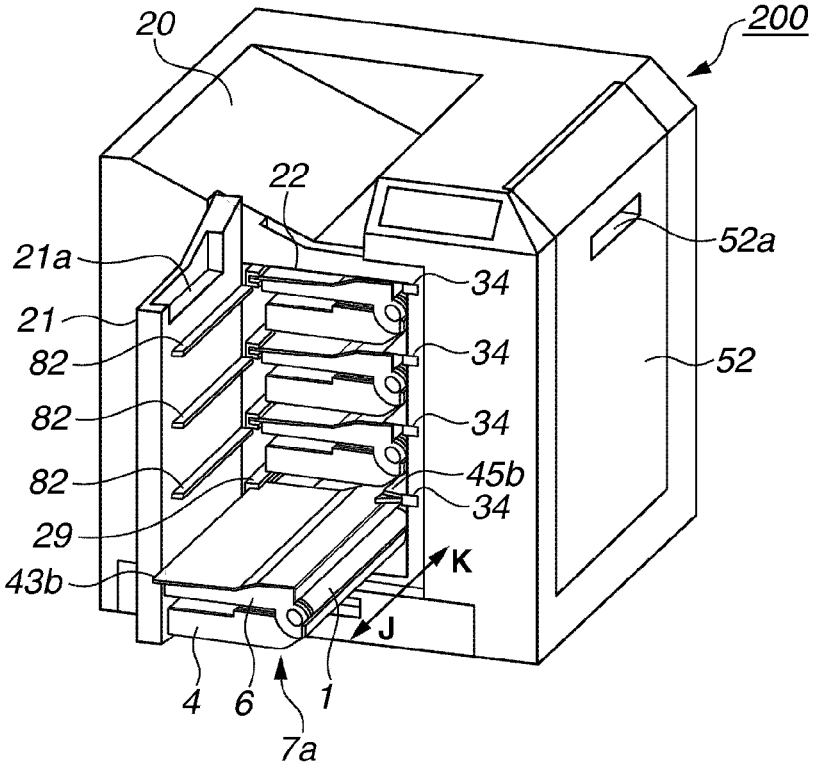

Next, a method for mounting the cartridge 7 will be described. The image forming apparatus 200 according to the second exemplary embodiment includes the door 21 at the front side as illustrated in FIG. 13A, and is configured in such a manner that the cartridges 7 can be individually pulled out and mounted on the opened door 21 as illustrated in FIG. 13B. In a similar manner to the first exemplary embodiment, the guide rib 43*b* of the photosensitive member unit 6 of each of the cartridges 7 is slid toward the back side along the guide groove 82 inside the door 21. Then, a protrusion 45*b* of the drum bearing member 45 at the back side of the cartridge 7 is guided by a right guide rail 34. Further, the guide rib 43*b* is configured so as to be guided to the guide rail 29 continuously from the guide groove 82 to be introduced to the back side of the main body.

The cartridge 7 introduced to the back side of the main body is brought into abutment with the conveyance belt unit 60 by a movement of the guide rail 29 from the state illustrated in FIG. 11B to the state illustrated in FIG. 11A. At this time, the guide rail 29 is coupled to the door 21 via a link mechanism (not illustrated), and the guide rail 29 moves to the right side as viewed in FIG. 11, in conjunction with an operation for closing the door 21. When the guide rail 29 moves to the right side, the cartridge 7 supported by the guide rail 29 also moves from the mounting/detachment position to the image forming position at the right side as viewed in FIG. 11.

In the thus-configured second exemplary embodiment, the main body can also have a compact size in the direction of the cartridge arrangement (the vertical direction) by disposing the light emitting elements 27*b* to 27*d* at the guide rails 29*a* to 29*c* in this order. Further, the light emitting element 27 and the light receiving element 28, and the light transmission member 31 and the light transmission member 32 can be located as close to each other as possible. Thus, the second exemplary embodiment can also acquire a similar effect to the first exemplary embodiment.

As described above, the tandem type image forming apparatus according to the first and second exemplary embodiments includes a moving member configured to move a first process cartridge to an image forming position, and a detection unit configured to detect a state of a second process cartridge adjacent to the first process cartridge. In addition, the moving member is configured to hold the detection unit. As a result, the distance between the adjacent process cartridges can reduce compared to the conventional configuration. Therefore, the first and second exemplary embodiments can realize a reduction in the size of the image forming apparatus main body in the direction in which the process cartridges are arranged. Further, the first and second exemplary embodiments can also realize reductions in the sizes of the transfer belt unit and the laser scanner unit that work on the plurality of process cartridges in the direction of cartridge arrangement.

Further, assuming that a first direction is a direction in which the moving member moves the first process cartridge to the position for forming an image, the detection unit is configured such that a detection region for detecting the state of the second process cartridge (the region between the transmission windows 31*a* and 32*a* in the first and second exemplary embodiments) is located at the downstream side of the detection unit in the first direction. As a result, even when the process cartridge moves in the first direction, the detection unit also moves in the first direction, whereby the distance between the detection region and the detection unit can be maintained, so that the state of the second process cartridge can be accurately detected compared to the conventional configuration. The light emitting element according to the first and second exemplary embodiments can achieve this effect by emitting light to the downstream side of the light emitting element in the first direction. The light receiving element according to the first and second exemplary embodiments can achieve this effect by receiving the detection light from the upstream side of the light receiving element in the first direction.

Further, according to the first and second exemplary embodiments, each developing unit is movable between a position where a developer borne by a developer bearing member and an image bearing member come in contact with each other, and a position where the developer borne by the developer bearing member and the image bearing member are separated from each other. Also in this configuration, the moving member also holds an image bearing member unit of the first process cartridge, and the moving member also holds the detection unit for detecting the state of the developing unit of the second process cartridge, so that the distance between the adjacent process cartridges can reduce.

In the first and second exemplary embodiments, the plurality of cartridges are referred to as the first to fourth cartridges for convenience of description, but these cartridge numbers may or may not correspond to the cartridge numbers recited in the claims.

Even if the process cartridges are being mounted in a different direction and are arranged in a different direction from the directions indicated in the first and second exemplary embodiments, a similar effect can be expected.

The above described exemplary embodiments discuss the detection unit optically detecting information about the toner amount in the developing unit. In another embodiment the detection unit detects the state of the process cartridge. In still another embodiment, the detection unit determines whether the process cartridge is mounted. In still yet another embodiment, the detection unit detects the toner amount collected in the cleaning frame as the information regarding the toner amount in the process cartridge. And, in still yet one additional embodiment the detection unit detects the ratio of a toner and a carrier (magnetic powder) in a developing unit of the two-component development system based on magnetic permeability. According to the present disclosure, in the tandem type image forming apparatus including the plurality of process cartridges, it is possible to reduce the size of the image forming apparatus main body in the direction in which the process cartridges are arranged by reducing the distance between the adjacent process cartridges.

While the present disclosure has been described with reference to exemplary embodiments, these embodiments are not seen to be limiting. The scope of the following claims is to be accorded the broadest interpretation so as to encompass all such modifications and equivalent structures and functions.

This application claims the benefit of Japanese Patent Application No. 2012-219617 filed Oct. 1, 2012, which is hereby incorporated by reference herein in its entirety.

What is claimed is:

1. A tandem type image forming apparatus configured to form an image using a plurality of process cartridges, the image forming apparatus comprising:

a moving member configured to support a first process cartridge among the plurality of process cartridges, and move the first process cartridge to a position for forming the image; and a detection unit configured to detect a state of a second process cartridge adjacent to the first process cartridge among the plurality of process cartridges, wherein the moving member holds the detection unit.

2. The image forming apparatus according to claim 1, wherein the detection unit has a detection region for detecting the state of the second process cartridge at a downstream side of the detection unit in a first direction, wherein the first direction is a direction in which the moving member moves the first process cartridge to the position for forming the image.

3. The image forming apparatus according to claim 1, wherein the detection unit includes a light emitting element configured to emit detection light for detecting the state of the second process cartridge, and wherein the light emitting element emits the detection light to a downstream side of the light emitting element in a first direction, wherein the first direction is a direction in which the moving member moves the first process cartridge to the position for forming the image.

4. The image forming apparatus according to claim 1, wherein the detection unit includes a light receiving element configured to receive detection light for detecting the state of the second process cartridge, and wherein the light receiving element receives the detection light from an upstream side of the light receiving element in a first direction, wherein the first direction is a direction in which the moving member moves the first process cartridge to the position for forming the image.

5. The image forming apparatus according to claim 1, wherein each of the plurality of process cartridges includes an image bearing member unit having an image bearing member configured to bear an electrostatic latent image, and a developing unit having a developer bearing member configured to bear a developer and develop the electrostatic latent image, wherein each of the plurality of process cartridges is configured to be movable to a position where the developer borne by the developer bearing member and the image bearing member come in contact with each other, and a position where the developer borne by the developer bearing member and the image bearing member are separated from each other, wherein the moving member holds the image bearing member unit of the first process cartridge, and wherein the detection unit is a unit for detecting a state of the developing unit of the second process cartridge.

6. The image forming apparatus according to claim 1, wherein the detection unit is a unit for detecting information regarding a toner amount in the second process cartridge.

7. The image forming apparatus according to claim 5, wherein the detection unit is a unit for detecting information regarding a toner amount in the developing unit.

8. The image forming apparatus according to claim 1, wherein the detection unit is located between the first process cartridge and the second process cartridge.

9. An image forming apparatus comprising:

a moving member configured to support a first process cartridge, and move the first process cartridge to a position for forming an image; and a detection unit configured to detect a state of a second process cartridge, wherein the moving member holds the detection unit.

10. The image forming apparatus according to claim 9, wherein the detection unit is a detection unit for detecting a remaining toner amount.

* * * * *